US005335048A

United States Patent [19]

Takano et al.

[11] Patent Number: 5,335,048

[45] Date of Patent: Aug. 2, 1994

[54] EFFICIENT CONTROL SYSTEM OF IMAGE FORMING APPARATUS

[75] Inventors: Yoshiaki Takano; Tadafumi Shimizu; Hiroyuki Ideyama; Manabu Kamitamari, all of Toyokawa; Kadotari Nishimori, Amagasaki; Yoshihiko Hatta, Toyokawa; Masazumi Ito; Tsugihito Yoshiyama, both of Toyohashi; Yoshifumi Shibata, Toyokawa; Yoshiaki Hata, Ashiya, all of Japan

[73] Assignee: Minolta Camera Kabushiki Kaisha, Osaka, Japan

[21] Appl. No.: 12,804

[22] Filed: Feb. 2, 1993

Related U.S. Application Data

[63] Continuation of Ser. No. 648,460, Jan. 30, 1991, abandoned.

[30] Foreign Application Priority Data

Jan. 30, 1990 [JP] Japan ..... 2-22714
Jan. 30, 1990 [JP] Japan ..... 2-22715

[51] Int. Cl.[5] ..... G03G 21/00
[52] U.S. Cl. ..... 355/204; 364/184
[58] Field of Search ..... 355/200, 202, 203, 204, 355/205, 206, 208, 209; 364/184, 185, 186

[56] References Cited

U.S. PATENT DOCUMENTS

| | | | |
|---|---|---|---|
| 3,893,175 | 7/1975 | Solomon | 346/33 M |
| 3,997,873 | 12/1976 | Thornton | 340/149 R |
| 4,167,322 | 9/1979 | Yano et al. | 355/204 X |
| 4,322,813 | 3/1982 | Howard et al. | 364/900 |
| 4,497,037 | 1/1985 | Kato et al. | 364/900 |
| 4,549,044 | 10/1985 | Durham | 179/5 R |
| 4,583,834 | 4/1986 | Seko et al. | 355/14 |
| 4,589,080 | 5/1986 | Abbott et al. | 364/552 |
| 4,739,366 | 4/1988 | Braswell et al. | 355/208 |
| 4,766,548 | 8/1988 | Cedrone et al. | 364/479 |
| 4,835,671 | 5/1989 | Sato et al. | 364/186 |
| 4,875,078 | 10/1989 | Resch, III et al. | 355/246 |
| 4,977,429 | 12/1990 | Tani et al. | 355/260 |
| 4,999,672 | 3/1991 | Rice, Jr. et al. | 355/202 |
| 5,021,826 | 6/1991 | Maruta | 355/205 |
| 5,021,828 | 6/1991 | Yamaguchi et al. | 355/209 |
| 5,023,817 | 6/1991 | Au | 364/550 |
| 5,057,866 | 10/1991 | Hill, Jr. et al. | 355/200 |
| 5,077,582 | 12/1991 | Kravette et al. | 355/206 |
| 5,084,875 | 1/1992 | Weinberger et al. | 371/291 |
| 5,214,772 | 5/1993 | Weinberger et al. | 395/575 |

FOREIGN PATENT DOCUMENTS

| | | | |
|---|---|---|---|
| 59-142559 | 2/1983 | Japan . | |
| 60-90460 | 5/1985 | Japan . | |
| 0271767 | 10/1989 | Japan | 355/204 |

OTHER PUBLICATIONS

Research Newsletter, Dataquest, Inc., Feb. 1989, CDIS Newsletter "Remote Diagnostics Tool Kit of the Future" pp. 1-6.

*Primary Examiner*—Michael L. Gellner
*Assistant Examiner*—Patrick J. Stanzione
*Attorney, Agent, or Firm*—Burns, Doane, Swecker & Mathis

[57] ABSTRACT

A control system of image forming apparatus in accordance with the present invention includes a plurality of image forming apparatus and a control unit connected to each of the image forming apparatus through a communication line, and each of the image forming apparatus includes a data transmitting device for transmitting information related to a consumption amount of consumable products to the control unit through the communication line, and the control unit includes a receiving device receiving the information transmitted from the image forming apparatus and determines a stock amount of the consumable products which a user of the image forming apparatus has on the basis of the information received by the receiving device.

21 Claims, 21 Drawing Sheets

UST USER STOCK TABLE

EFFICIENT CONTROL SYSTEM OF IMAGE FORMING APPARATUS

This application is a continuation of application Ser. No. 07/648,460, filed Jan. 30, 1991 now abandoned.

CROSS-REFERENCE TO RELATED, COPENDING APPLICATION

Related, copending application of particular interest to the instant application is U.S. Ser. No. 526,900, entitled "Management System for Managing Maintenance Information of Image Forming Apparatus", filed May 22, 1990 and assigned to the same assignee of the instant application.

BACKGROUND OF THE INVENTION

1. Field of the Invention

The present invention relates to image forming apparatus, and more particularly to image forming apparatus control systems in which image forming apparatus and a control unit are connected to each other through a communication line.

2. Description of the Related Art

Image forming apparatus such as copying machines employing the electrophotographic process, facsimiles and optical printers are widely used as means for forming hard copy images. Such image forming apparatus usually include CPUs (Central Processing Unit) including microprocessors and so forth, in which each portion is controlled according to a control program stored in a memory (usually a ROM) in advance.

Generally, image forming apparatus such as a copying machine forming a hard copy image employing the electrophotographic process, a facsimile and an optical printer have sensors for sensing residual quantities of constable products such as paper and toner provided in the apparatus, and a display for demanding a user for supply of consumable products is made when they are running out.

Thus, a user provides consumable products kept as stocks for supply outside the apparatus into the apparatus to maintain the apparatus in an image formable condition.

Now, conventionally, as shown in Japanese Patent Laying-Open No. 59-142559, for example, a control system in which each of copying machines and a control unit (host) are connected to each other through a communication line in order to concentrically control a plurality of copying machines has been known.

Copying machines configuring such a control system have means for storing data corresponding to control items and transmit the data to the host according to commands from the host.

Conventional control items are mainly for grasping operational (use) conditions of copying machines, such as the number of copies for each user and sizes of paper used.

That is, conventional control systems are configured with an object of enabling easy totalization of data for implementing rational use of each copying machine at users having a plurality of copying machines such as official agencies and companies, that is, payment by beneficiaries of maintenance cost and equalization of used amount among users.

Recently, in order to improve after-sale service for image forming apparatus, a service management system is in progress in which a host provided at a service base (service station) on a seller side (maker side) of the image forming apparatus and each of a plurality of image forming apparatus provided on each user side (customer side) are connected to each other in an on-line manner.

In the present specification, the after-sale service means the whole customer service provided from the seller side to the user including maintenance as activities for keeping operational conditions (hereinafter, referred to as "conditions") of image forming apparatus nominal and activities for operational convenience for users such as supply of consumable products such as paper and toner to users and explanation of the methods of using the apparatus.

As described above, a user can know the lack of consumable products inside image forming apparatus. Conventionally, however, a user sometimes overlooks the lack of stocks of the consumable products. That is, in some cases, a user notices the lack of stocks of consumable products just when he is supplying consumable products into the image forming apparatus.

A user who has noticed the lack of stocks makes contact with the service station demanding supply of consumable products. In this case, there is a problem that the image forming apparatus is unusable (machine-down) until the consumable products are supplied.

On the other hand, conventionally, replacement of a control program in an image forming apparatus (hereinafter, referred to as "program conversion") has been implemented as a part of the after-sale service.

The objects of the program conversion include addition of new functions (version-up), adaptation for the installation circumstances, users' convenience in operation and implementation of users' favorite image quality.

In such program conversion, actually, a serviceman takes a memory element storing an existing control program out of an image forming apparatus and loads a memory element storing a new control program instead. That is, a hardware (memory element) is replaced.

There is a problem, however, that memory element conversion takes a long time since a control portion including a memory element (a control circuit board) is usually located in a center portion of a main body of an image forming apparatus. Especially, in the case where program conversion such as version-up is performed for a large number of image forming apparatus provided at respective users, a large amount of labor is required to increase the costs of the after-sale service.

In addition, in memory element replacement, other parts are damaged or bad-influenced in some cases.

SUMMARY OF THE INVENTION

It is an object of the present invention to improve the convenience of use in image forming apparatus.

It is another object of the present invention to prevent machine down due to lack of consumable products.

It is still another object of the present invention to quickly convert a program in image forming apparatus.

It is yet another object of the present invention to facilitate program conversion in image forming apparatus.

It is still another object of the present invention to enable program conversion at any time in image forming apparatus.

In order to achieve the above objects, a control system of image forming apparatus according to one aspect of the present invention is a control system of image forming apparatus including a plurality of image forming apparatus and a control unit connected to each of the image forming apparatus through a communication line, wherein each of the image forming apparatus includes operational data transmitting means for transmitting information related to an amount of consumption of consumable products to the control unit through the communication line, and the control unit includes operation data receiving means for receiving the operation data transmitted from the image forming apparatus, and determination means for determining an amount of stock of consumable goods which a user of image forming apparatus has on the basis of the operational data received by the operational data receiving means.

The control system of image forming apparatus configured as described above determines an amount of stock of consumable goods on the basis of the information related to the consumable goods transmitted from the image forming apparatus, so that shortage of consumable goods does not occur and the convenience in use enhances.

In order to achieve the above objects, an image forming apparatus according to another aspect of the present invention is an image forming apparatus capable of connecting with an external device through a communication line, including image forming means for forming an image on paper, storing means for storing a control program for controlling the image forming means, control means for controlling the image forming means in accordance with the control program stored in the storing means, receiving means for receiving the information transmitted through the communication line from the external device, and means for changing contents of the control program stored in the storing means.

In an image forming apparatus configured as described above, the contents of the stored control program are changed on the basis of the information transmitted from the external device, so that the program conversion is easy and quick.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described below referring to the figures.

Figure 1:
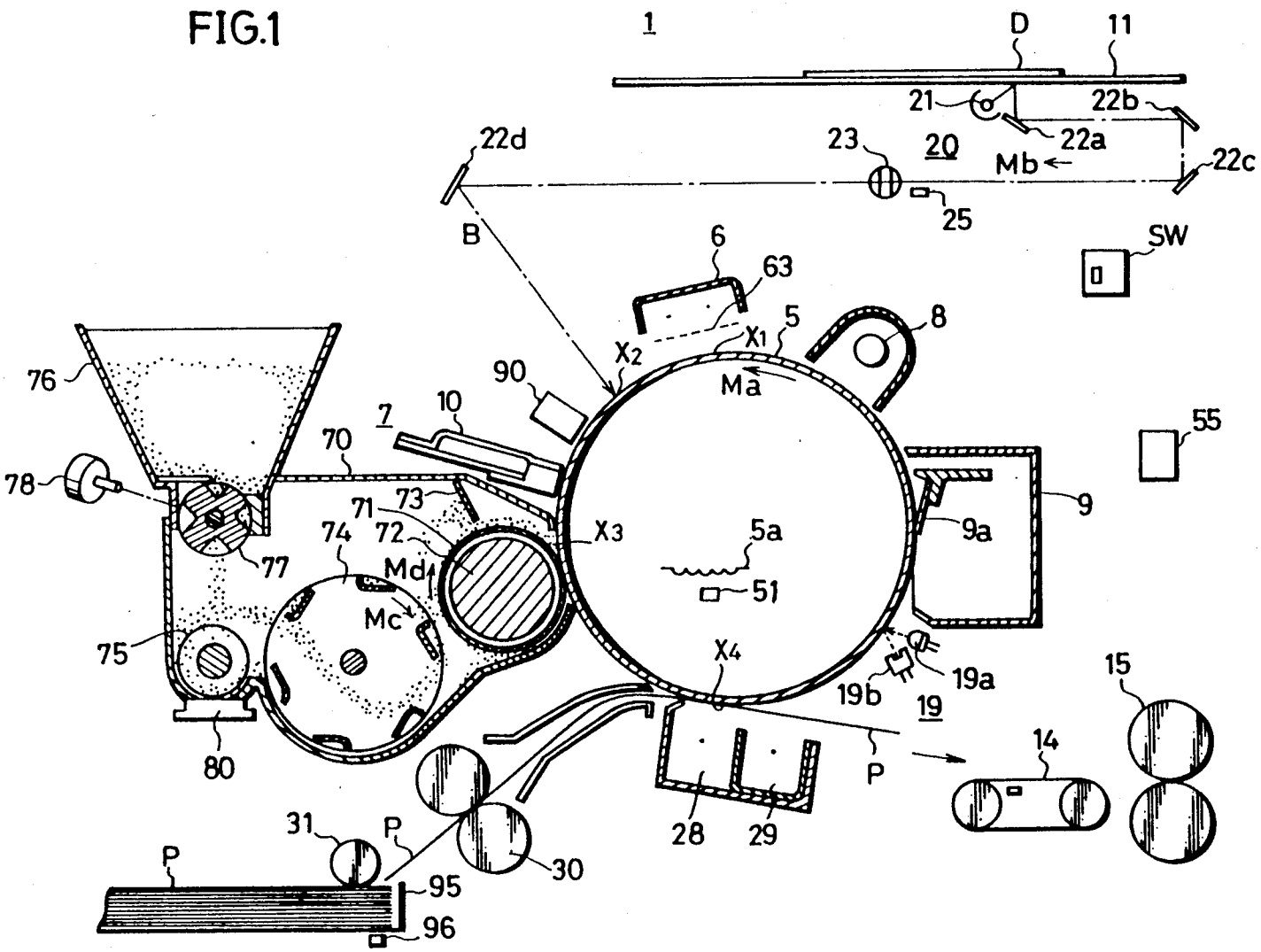
FIG. 1 is a front sectional view showing a main portion of a copying machine in accordance with one embodiment of the present invention.

FIG. 1 is a front sectional view showing a main portion of a copying machine 1.

In the figure, a photoreceptor drum 5 is provided rotatable in the direction of the arrow Ma at a constant circumferential speed v. In the drum, a heater 5*a* for heating photoreceptor drum 5 and a temperature sensor 51 are provided. Heater 5*a* is on/off controlled on the basis of an output signal of temperature sensor 51, the temperature of photoreceptor drum 5 is kept constant thereby.

Around the drum 5, for the electrophotographic process, a corona charger 6, an eraser 10 for portions between images, a developing device 7, a transfer charger 28, a copy paper separation charger 29, a cleaning device 9, and a main eraser 8 are provided. Corona charger 6 is a charger of Scorotron type having a mesh-like grid 63.

Between an exposure position X2 and eraser 10, a surface electrometer (VO sensor) 90 for measuring a surface potential (VO) of photoreceptor drum 5 is provided. Also, between the copy paper separation charger 29 and cleaning device 9, a reflection type photosensor (AIDC sensor) 19 including an emitter element 19*a* and a receiving element 19b is provided for measuring the density of a reference toner image.

The surface of photoreceptor drum 5, passing under the corona charger 6, is evenly charged and exposed by an optical system 20 at the exposure position X2. By the exposure, the surface charge of photoreceptor drum 5 is partially removed and a latent image corresponding to an original D is formed on the surface of photoreceptor drum 5. The surface charge except for the portion of the latent image is eliminated by eraser 10.

The optical system 20 includes an exposure lamp 21 for irradiating the original D provided on a platen glass 11, mirrors 22a–d for leading reflected light B from the original D to the exposure position X2 and a projecting lens 23. In the vicinity of projecting lens 23, an AE sensor 25 for sensing an amount of the reflected light from the original D is provided.

In exposure-scanning to the original D, exposure lamp 21 and mirror 22a move at a speed of v/m (m indicates a copying magnification) in the direction designated by the arrow Mb, and mirrors 22b, 22c are movable at a speed of v/2m.

The latent image formed on the surface of photoreceptor drum 5 is developed by developing device 7 to appear as a toner image.

The developing device 7 performs a so-called non-reversal development, in which a developer composed of a mixture of magnetic carrier and insulative toner is employed, and the toner sticks to a latent image (a charge existing portion, or a non-exposed portion) passing through a developing position X3 in the well known magnetic brush system. In a developer tank 70, there are a developing sleeve 71 having a magnetic roller 72 therein, a regulating plate 73, a bucket roller 74 and a screw roller 75, and a toner concentration sensor (ATDC sensor) 80 is provided below the screw roller 75.

When the bucket roller 74 rotates in the direction designated by the arrow Mc, the developer sticks to the outer peripheral surface of the developing sleeve 71 with the magnetic force of the magnetic roller 72, which is transported to the developing position X3 with the rotation of the developing sleeve 71 in the direction of the arrow Md. The toner concentration sensor 80 measures the weight percentage T/C [wt%] of the toner with respect to the entire developer based on the permeability of the developer.

A toner tank 76 is provided above developing tank 70 and a toner supply roller 77 is provided in the bottom portion thereof. With the toner supply roller 77 rotation-driven by a supply motor 78, the toner is supplied from toner tank 76 to screw roller 75. The supplied toner is stirred and mixed with the developer already existing inside the developing tank 70 with the rotation of screw roller 75 to be sent to bucket roller 74. Frictional electrification is produced in the stirring and mixing, so that the magnetic carrier and the toner are charged in different polarities. The toner of negative polarity sticks to the surface of photoreceptor drum 5 at the developing position X3 because of electrostatic adsorption with the surface charge of photoreceptor drum 5. Then, in order to prevent the toner from sticking because of the residual charge (charge remaining in the exposed portion) on the surface of photoreceptor drum 5, developing bias VB of a predetermined voltage is applied to developing sleeve 71.

On the other hand, paper P is fed one by one from detachable paper feed cassette 95 by paper feed roller 31, transported while keeping timing with rotation of photoreceptor drum 5 by timing roller 30 to a transfer position X4 where a toner image is transferred to the paper P by transfer charger 28. The paper P on which the toner image is transferred is separated from photoreceptor drum 5 by copy paper separation charger 29, transported to fixing device 15 by transporting belt 14, and discharged out of copying machine 1 after fixing of a toner image.

Subsequently, on the surface of photoreceptor drum 5, remaining toners are removed by a cleaning blade 9a of a cleaning device 9 and the residual charge is removed by main eraser 8 for the next exposure. The light amount of main eraser 8 is controlled constant on the basis of an output of a light amount sensor (not shown).

A paper sensor 96 including a photosensor detecting absence/presence of paper P is provided in paper feed cassette 95. Replacement detecting portion 40 for detecting presence/absence of replacement of each device (part) is provided in each mounting portion of photoreceptor drum 5, developing device 7, fixing control portion 55 drive-controlling fixing device 15 and so forth.

Figure 2:
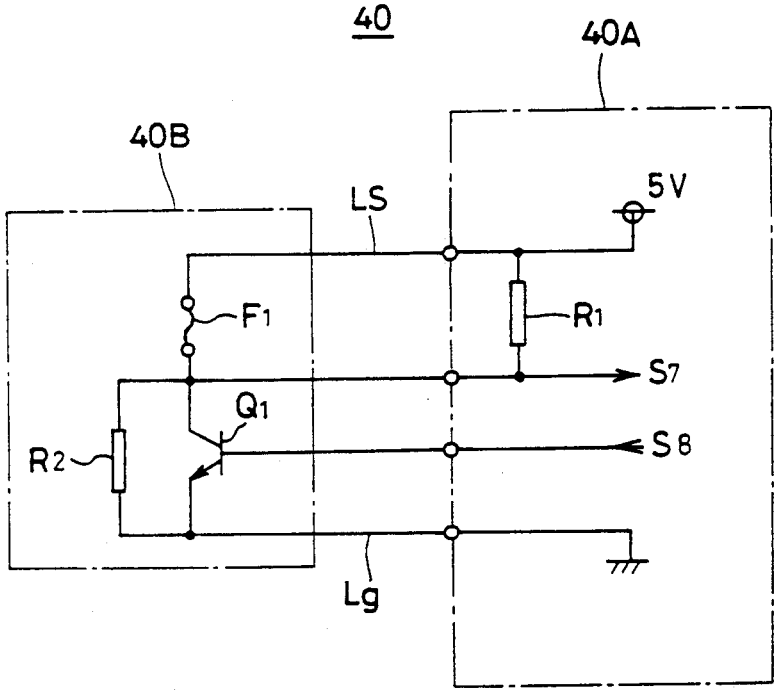
FIG. 2 is a circuit diagram showing a configuration of a replacement detecting portion in accordance with the embodiment of the present invention.

FIG. 2 is a circuit diagram showing a configuration of replacement detecting portion 40.

The replacement detecting portion 40 includes a fuse F1, a transistor Q1 of NPN type, and a resistor R2 provided on the parts side 40B, and a resistor R1 provided on the main body side 40A of copying machine 1, having fuse F1 and a collector-emitter line of transistor Q1 connected in series between a power source line Ls and a ground line Lg, and resistors R1 and R2 each connected in parallel with respect to fuse F1 and the collector-emitter line. The resistance value of resistor R2 is smaller than that of resistor R1.

In replacement detecting portion 40, fuse F1 is in a conductive state at the point of newly mounting the part. That is to say, immediately after replacement, the value of a signal S7 indicating a connecting point potential of fuse F1 and the collector of transistor Q1 is at a power source voltage (5 volt). Subsequently, in an automatic extracting process of replaced parts which will be described later, a signal S8 turning on transistor Q1 is momentarily applied to the base of transistor Q1. Thus, fuse F1 is cut off, and the value of the signal S7 attains a terminal voltage of resistor R2 (approximately 0 volt). That is, with existence/absence of change of a value of the signal S7 upon application of signal S8, it can be detected whether the part is newly mounted or not.

Figure 3:
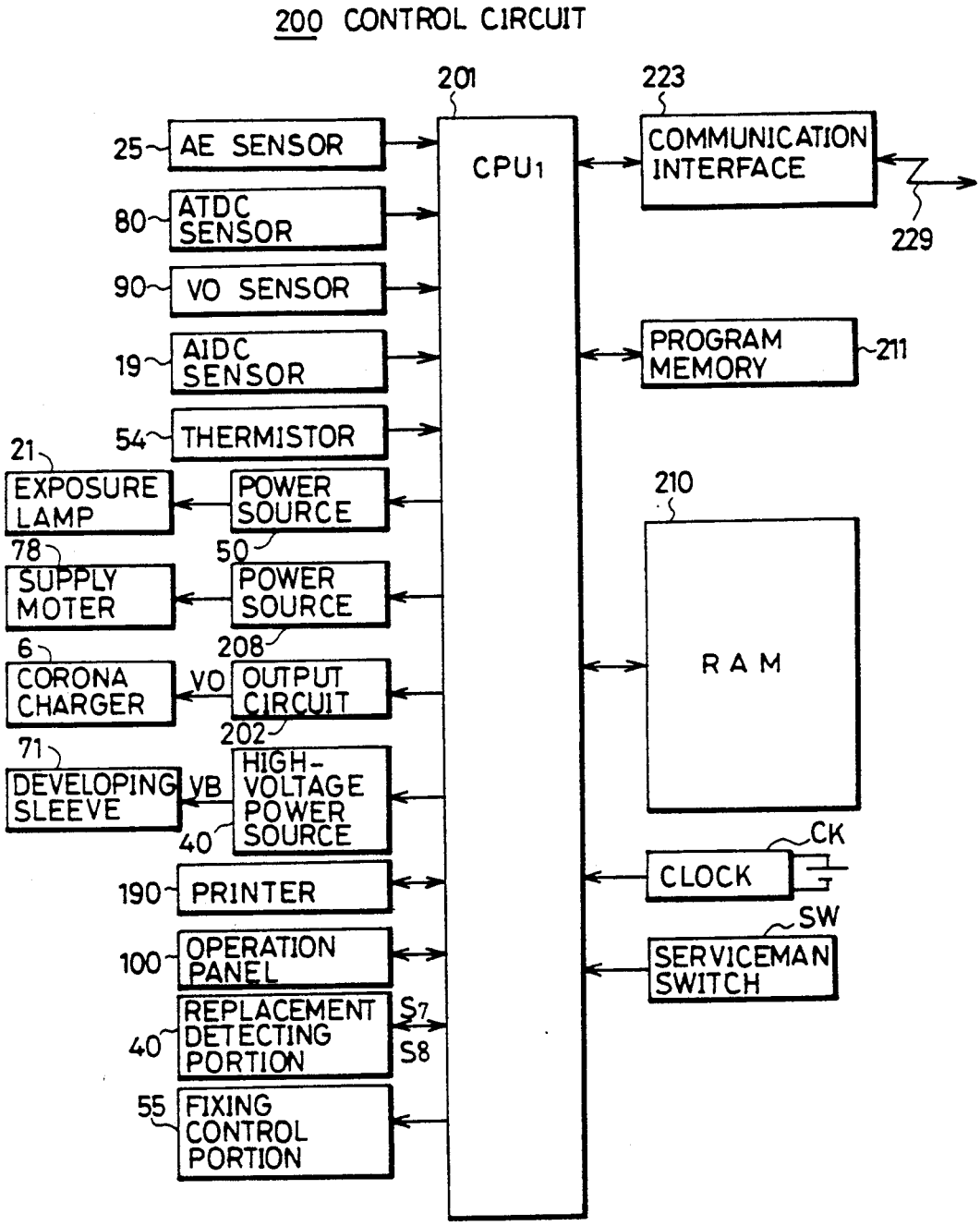
FIG. 3 is a block diagram showing a configuration of a control circuit of the copying machine of FIG. 1.

FIG. 3 is a block diagram of a control circuit 200 of the copying machine 1 of FIG. 1.

Control circuit 200 includes a CPU 201 totally controlling copying machine 1, a program memory 211 in which a control program is stored, a writable/readable memory (RAM) 210 for various kinds of data employed for control of the electrophotographic process and control of copying machine 1 and so forth, and a communication interface 223 for communicating with control unit 2 described later.

The data stored in memory 210 include reference data BD which is a reference for controlling the electrophotographic process, condition data CD which shows the past and the present conditions including information of set values in each portion such as a light amount of exposure lamp 21, an output voltage of corona charger 6, a bias voltage applied to developing sleeve 71 appropriately changed in control, information of installation circumstances such as temperature and humidity, and information of detected values such as a surface potential (Vo) of a photoreceptor and image density measured by AIDC sensor 19, and the user data UD related to operational control of a user such as the accumulated number of copies and consumed amount of consumable products, and work data WD indicating contents of maintenance work by a serviceman.

To CPU 201, signals from each portion such as the above-described AE sensor 25, ATDC sensor 80, VO sensor 90, AIDC sensor 19, a clock CK counting the time, and the above-described replacement detecting portion 40 are supplied. The CPU 201 supplies control signals to exposure lamp power source 50 for lightening exposure lamp 21, power source 208 for driving supply motor 78, output circuit 202 for setting a surface potential VO of photoreceptor drum 5, high voltage power source 40 for applying developing bias VB, fixing control portion 55, replacement detecting portion 40 and so forth.

The control program PR includes a main control program for controlling operation directly connected with image forming and a sub control program for controlling data processing related to program change, but the control program PR will be described as the main control program hereinafter.

The program memory 211, into which the control program PR can be written, includes a nonvolatile storage device maintaining storage conditions of the control program PR which is backed-up by a cell or the like even after the power source of the copying machine 1 is turned off.

The CPU 201, in addition to controlling the photoelectric process, receives the control program PR transmitted from control unit 2 for controlling the data processing for storage into program memory 211.

The CPU 201 also controls communication of transmitting the data of memory 210 to external devices in response to commands from external devices. The above-described replacement detecting portion 40 provided in each portion, operation panel 100 and small size printer 190 are also connected to CPU 201.

Furthermore, CPU 201 counts the number of printing by copying machine 1, the number of pieces of consumed paper of each size, the number of toner supply and so on, which are stored in RAM 210 as operation data OD.

A modem for data communication employing telephone line 230 is incorporated in communication interface 223. The communication interface 223 is arranged as an additional device outside the main body of copying machine 1, driving power of which is supplied from copying machine 1.

Figure 4:
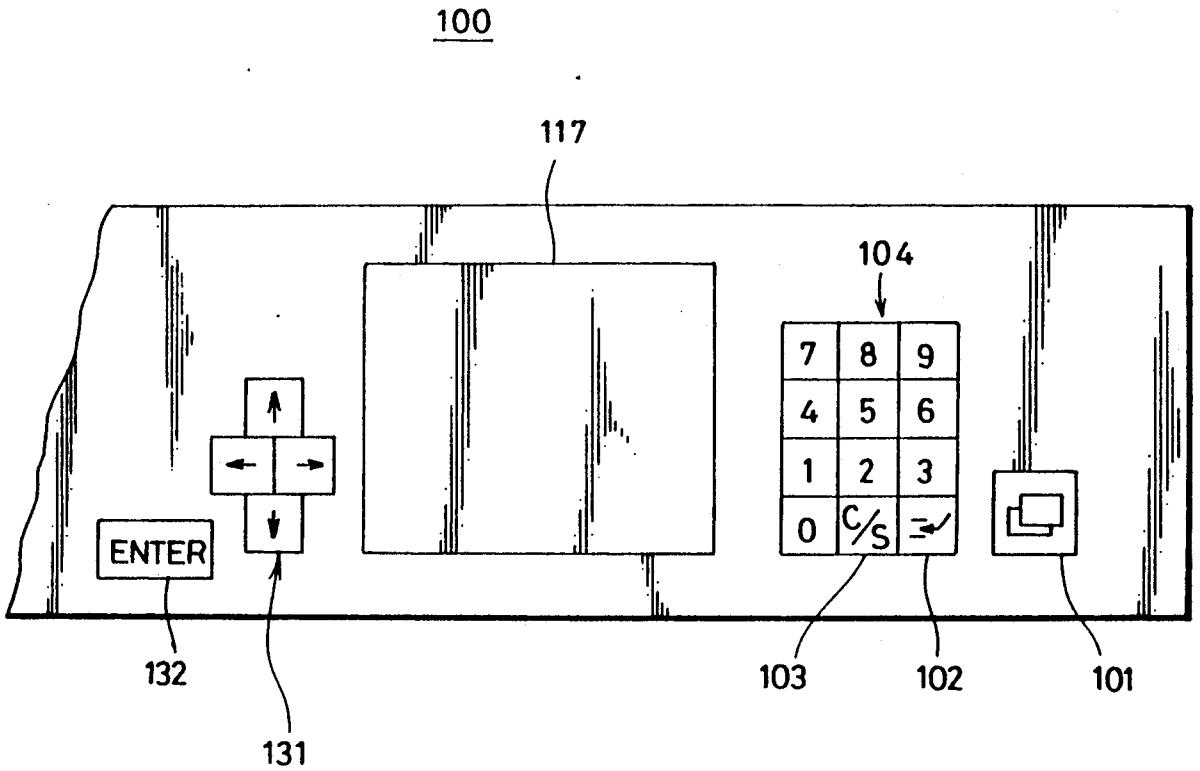
FIG. 4 is a plane view showing a part of an operation panel of the copying machine of FIG. 1.

FIG. 4 is a plan view showing a portion of operation panel 100 of the copying machine 1 of FIG. 1.

Operation panel 100 includes a print key 101 for starting copying operation, a group of ten keys 104 having keys corresponding to each numeral, 1, 2, ... 9, 0, an interruption key 102, a clear-stop key 103 for releasing setting of copying conditions, a message display portion 117 composed of a liquid crystal display, cursor keys 131 and an ENTER key 132.

In the message display (may be referred to as "a display") 117, selection displays such as of copying conditions including the number of copies and copying magnification, and various kinds of copying modes such as magnification/minification and duplex copy are normally made. When a mode for serviceman use only is selected upon operation of a serviceman switch SW in copying machine 1, however, the display is switched to make a selection display for maintenance work.

Cursor key 131 is for moving a cursor to a position of desired selection item on the screen of display 117. Upon push-down of ENTER key 132, a process corresponding to the selection item of the cursor position is carried out.

Figure 5:
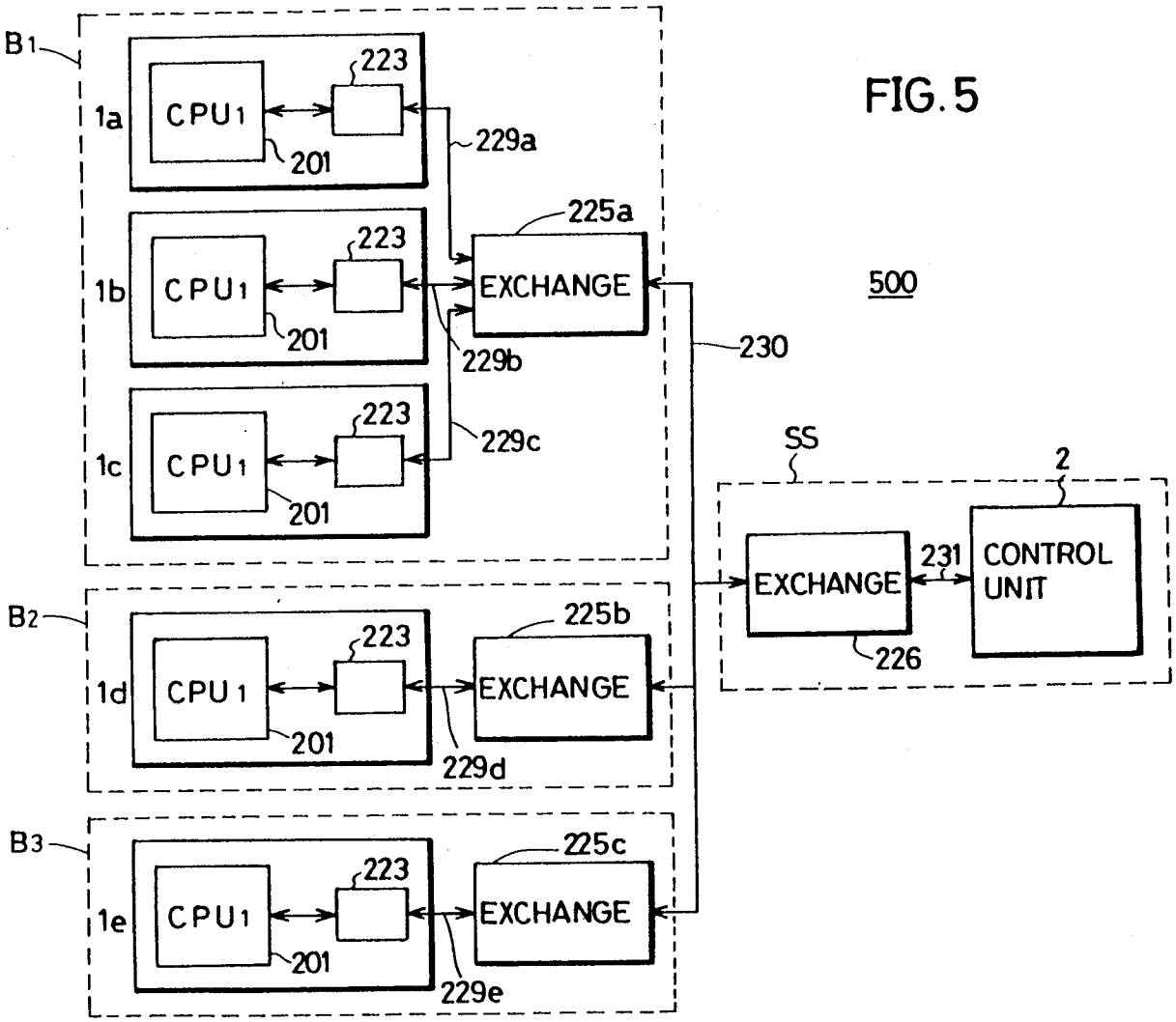
FIG. 5 is a block diagram showing a configuration of a control network system in accordance with the embodiment of the present invention.

FIG. 5 is a block diagram showing a configuration of a control network system 500.

The control network system 500 has five copying machines 1*a*–1*e* of the same type provided at a user, and a control unit 2 at a service station SS made on-line using telephone line 230, in which the copying machines 1*a*–1*c* are provided in a building B1 having interior wiring network with automatic exchange 225*a* and interior lines 229*a*–*c*, and the copying machines 1*d* and 1*e* are provided in buildings B2 and B3, respectively, and connected to telephone line 230 through automatic exchanges 225*b* and 225*c*.

In the description below, one which receives/transmits information from and to control unit 2 is referred to as "copying machine 1" among copying machines 1*a*–1*e*.

On the other hand, control unit 2 is connected to telephone line 230 through an exchange 226 at the service station SS and an extension 231.

Each copying machine 1*a*–1*e* and control unit 227 can also be directly connected to each other without using exchanges 225*a*–*c*, 226.

Figure 6:
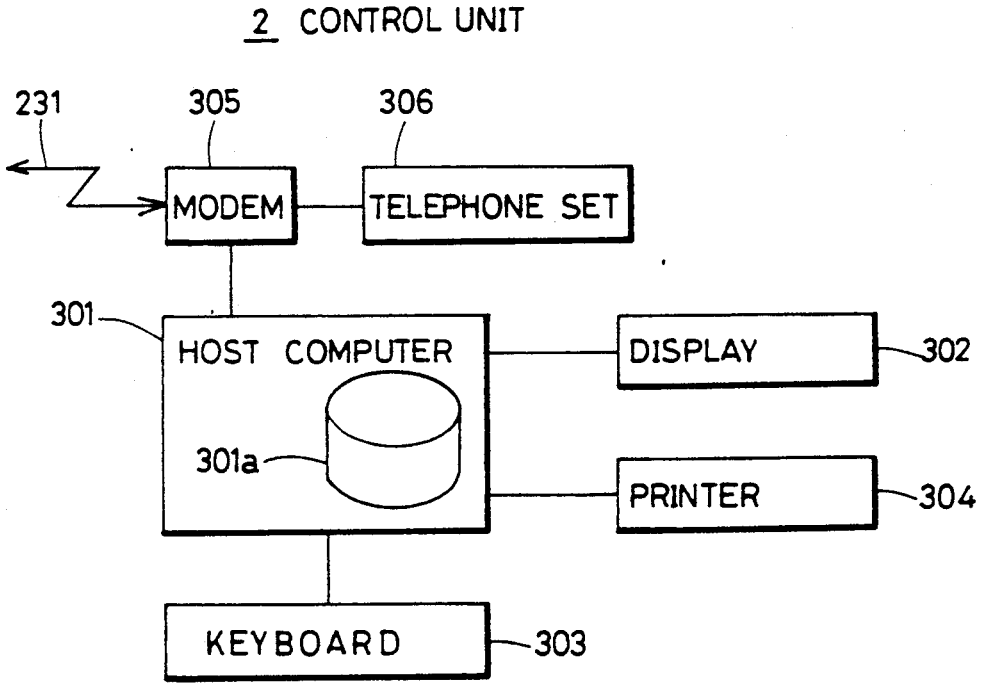
FIG. 6 is a block diagram showing a configuration of the control unit of FIG. 5.

FIG. 6 is a block diagram showing a configuration of control unit 2.

Control unit 2 includes a host computer 301 carrying out various kinds of processes according to the software, a display 302 for displaying, a keyboard 303 as operation input means, a printer 304 for printing, a modem 305 for communication with a plurality of copying machines provided at each user through telephone line 230, and a telephone set 306 for communication between a serviceman and a user. A storage device 301*a* for accumulating the history information MRD showing details of maintenance for respective copying machines 1*a*–1*e*, a stock table UST for dealing with the stock amount of consumable goods (toner, paper P etc.) at each copying machine, and a trouble table TT for supporting maintenance work by a serviceman is incorporated in host computer 301.

Figure 7:
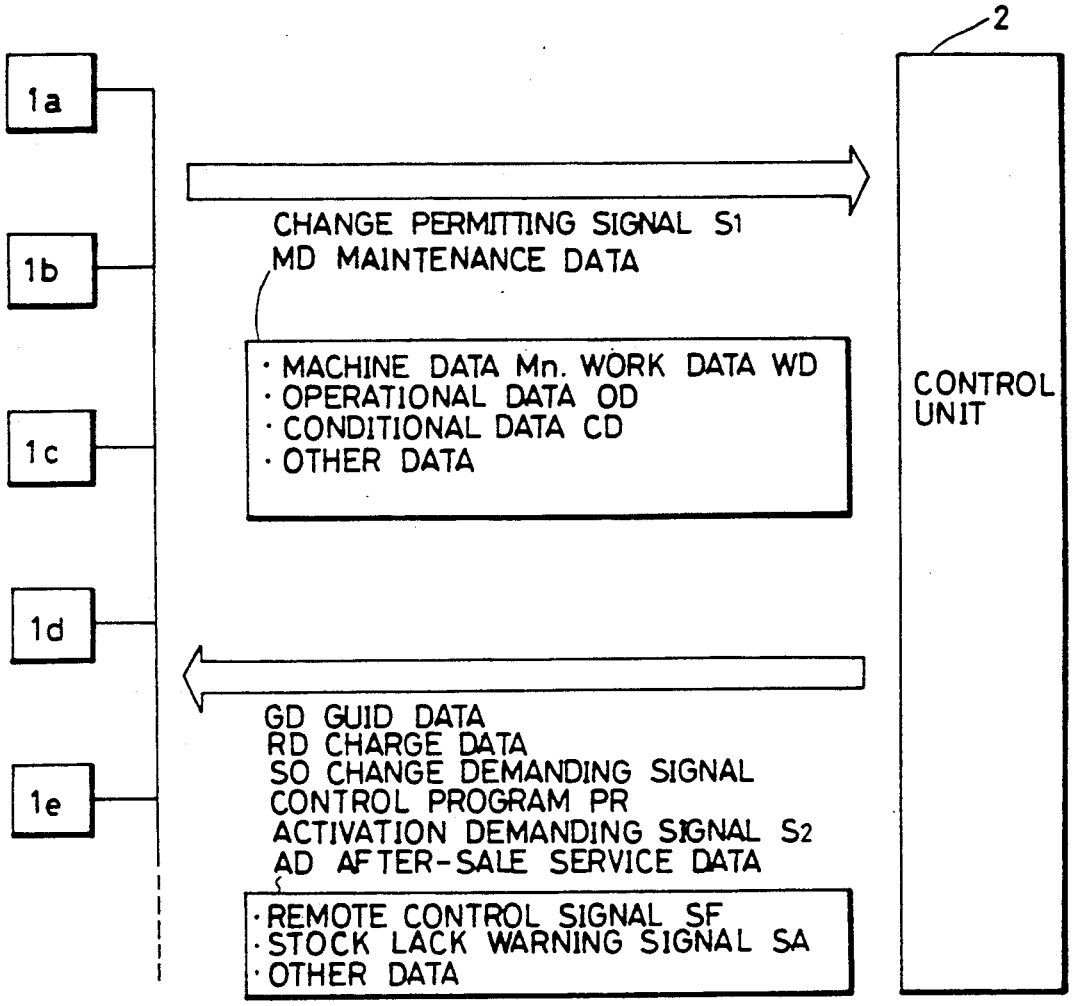
FIG. 7 is a diagram showing contents of communication of the control network system of FIG. 5.

FIG. 7 is a diagram showing contents of communication in the control network system 500 of FIG. 5.

Each of copying machines 1*a*–1*e* transmits the maintenance data MD at an appropriate time (for example, upon turning on of a power source or a predetermined time).

The maintenance data MD includes a machine number Mn for specifying any of copying machines 1*a*–1*e*, operation data OD showing conditions of use of consumable goods, condition data CD showing conditions and work data WD showing contents of maintenance work by a serviceman.

The work data WD includes above-described condition data, complementary condition data HCD corresponding to information related to conditions the serviceman himself found out with his sense, and implemented items actually carried out by the serviceman (for example, adjusted portions, cleaned portions, replaced parts and so forth). The serviceman can read a copied image using an image reader to use the image data as a part of the complementary condition data HCD.

On the other hand, as will be described later, the host computer 301 of control unit 2, on the basis of the maintenance data MD transmitted from each copying machine 1a–1e, carries out an automatic diagnosis process for detecting conditions of each copying machine 1a–1e and a stock management process for preventing lack of stock of consumable goods at each user, and transmits after-sale service data AD including a remote control signal SF and a stock lack warning signal SA to the particular one of copying machines 1a–1e.

The control unit 2 transmits the guide data GD for informing the serviceman of the work procedure appropriate for conditions of copying machine 1 to the objective copying machine 1 for maintenance.

Thus, in copying machine 1, with a guidance message displayed in display 117 on the basis of the guide data D, the serviceman proceeds his work following the message to quickly and appropriately perform checking or repair of troubles.

The work data WD transmitted to control unit 2 is stored in storage device 301a in host computer 301 together with the work data WD, corresponding to each of other copying machines 1a–1e collected in the same way, and accumulated as the history information MRD corresponding to each copying machine or the field information FD.

Accordingly, as compared to off-line information collection in which, for example, a serviceman writes contents of his work in a service management sheet and brings it back to the service station SS, the history information MRD and the field information FD have enhanced reliability and can be accumulated more easily.

The host computer 301, on the basis of the field information FD, sequentially carries out data processing processes such as a totalization process of frequency of trouble occurrence and an analyzing process for implemented items effective as measures for troubles, to produce new guide data GD for enhancing efficiency in maintenance. That is, every time information showing contents of field work is added to the field information FD, the guide data GD is updated in consideration of the new information in order to improve procedures of the field work.

The host computer 301 also, in the field work, carries out an extracting process of the guide data GD corresponding to the condition of copying machine 1 indicated by the condition data CD and the complementary condition data HCD transmitted from copying machine 1, that is, a trouble diagnosis process, and transmits the guide data GD in accordance with the diagnosis result to copying machine 1 for real time support for the serviceman.

In producing the guide data GD, it is possible to take the work data WD as external events for trouble diagnosis in the field of the artificial intelligence and utilize it for estimating a cause of a trouble.

Furthermore, the host computer 301 calculates on the basis of the work data WD the work charge by synthesizing charges determined for each implemented item or the work time, prices of replaced parts, discount ratio determined for each user and so forth, and transmits the charge data RD indicating the calculated result to the particular copying machine 1.

In copying machine 1, on the basis of the transmitted charge data RD, as shown in FIG. 17D, while the work charge is displayed in display 117, the implemented items and the work charge are printed out by printer 190 as needed.

In this way, the serviceman can omit the burden of calculating a work charge and also can show the user a precise work charge.

In the control network system 500, an exchange demand signal SO is transmitted from control unit 2 to a copying machine 1, among copying machines 1a–1e, which requires program exchange for version up, adaptation to installation circumstances, or for satisfying user's demand and so forth.

Copying machine 1, upon reception of an exchange demand signal SO, waiting for a condition where the program exchange is possible after completion of copying operation or the like, transmits an exchange permitting signal S1 to control unit 2 and also forbids starting operation thereafter.

Control unit 2 transmits a new control program PR to copying machine 1 upon receiving the exchange permitting signal S1. The transmitted new control program PR is received by copying machine 1 and sequentially stored in program memory 211.

Then, upon completion of transmitting the control program PR, control unit 2 successively transmits an activation demand signal S2.

Thus, in copying machine 1, operation is controlled according to the new control program PR.

In the description below, a new control program PR is referred to as "new program PR2", and an existing control program PR stored in the copying machine 1 before updating the program is referred to as "old program PR1".

Figure 8:
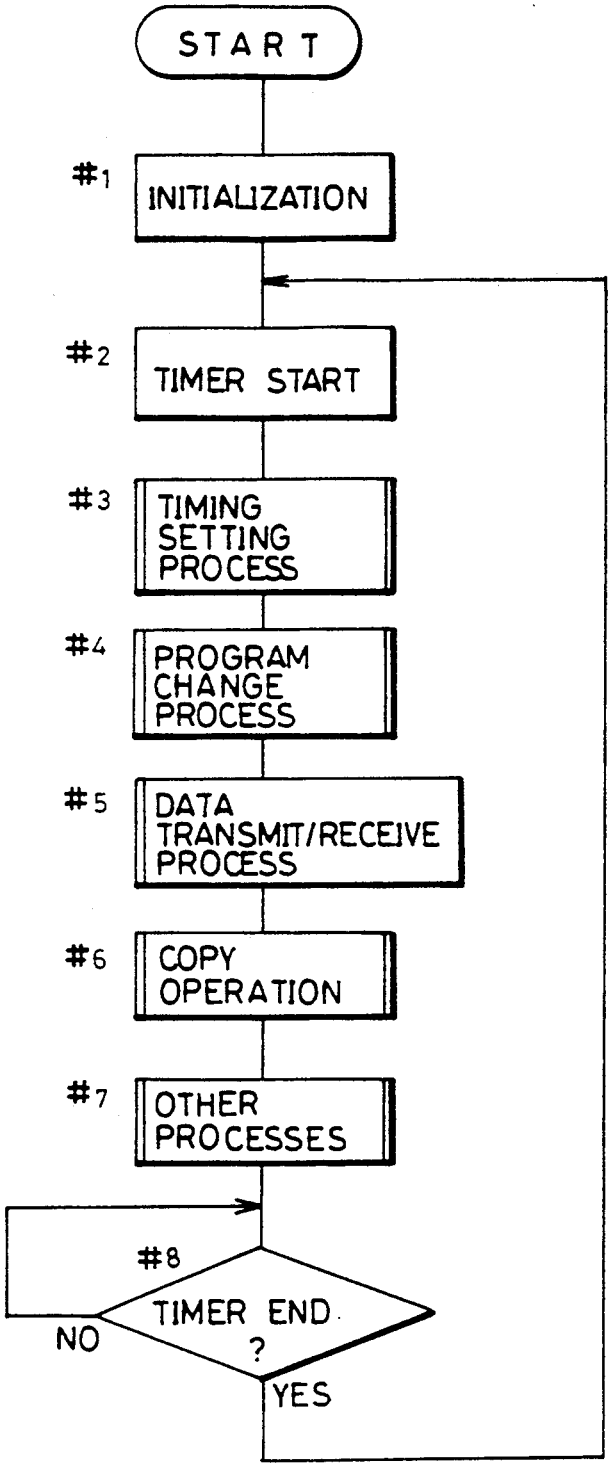
FIG. 8 is a flow chart diagram showing a main routine of a CPU of the copying machine in accordance with one embodiment of the present invention.

FIG. 8 is a main flow chart diagram of a CPU 201 of copying machine 1.

When the power source is turned on, initialization is made in step #1 and an internal timer is started in step #2.

Then, the subroutines such as a timing setting process (step #3), a program change process (step #4), a data transmission/reception process (step #5) and so forth are sequentially carried out and copying operation is controlled according to the control program PR for copying operation stored in a predetermined storage area of RAM 210 (step #6). Subsequently, other processes such as key input are carried out (step #7), and it returns to step #2 upon the end of the internal timer.

Figure 9:
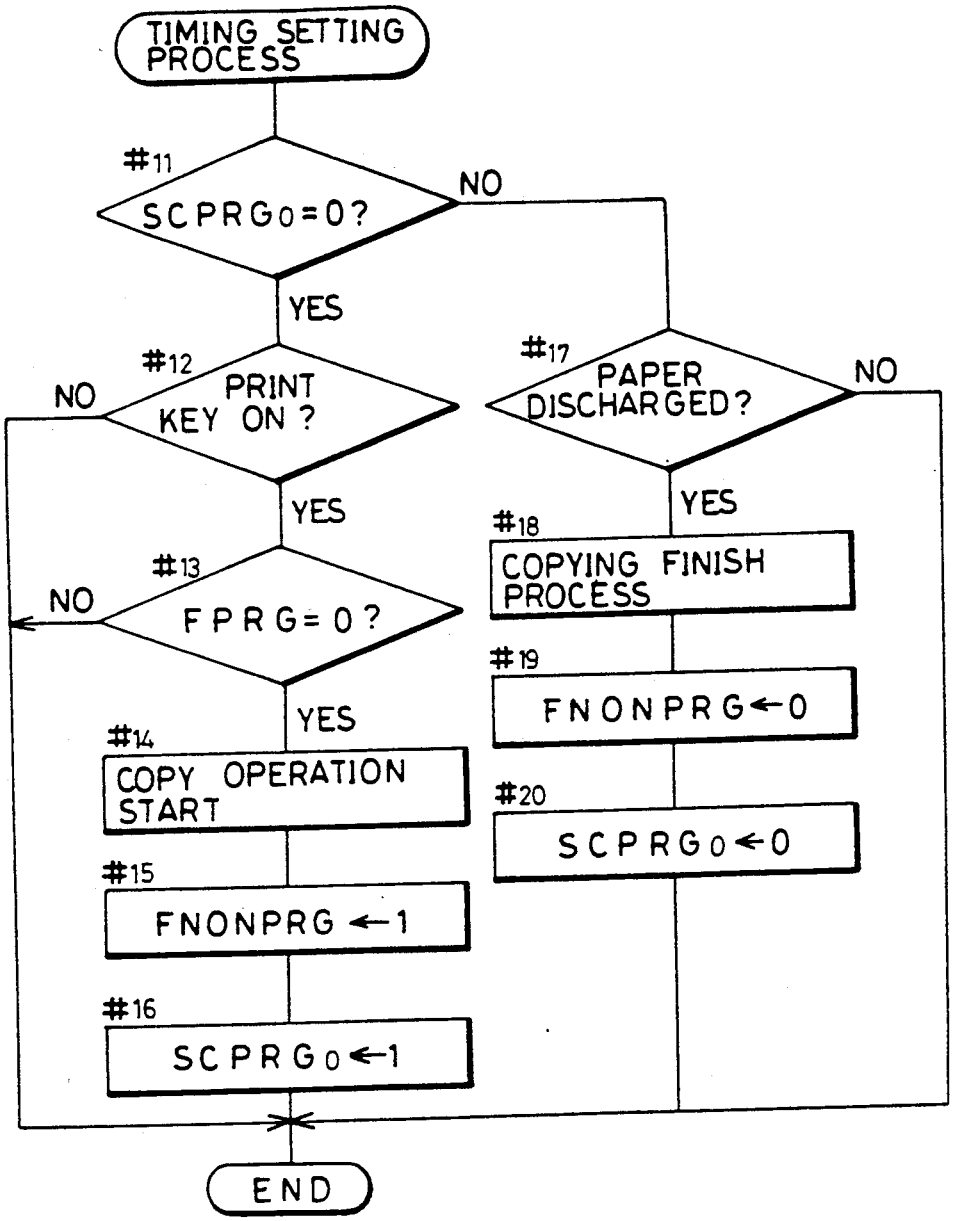
FIG. 9 is a flow chart diagram showing specific contents of a timing setting process routine of FIG. 8.

FIG. 9 is a flow chart diagram showing specific contents of the timing setting process of the program conversion of FIG. 8.

In copying machine 1, copying operation (the electrophotographic process) can not be interrupted. That is, after starting feeding paper P, a series of processes of latent image forming, developing, transferring, fixing and discharge of the paper P should be continuously carried out. Accordingly, if a conversion demanding signal SO is applied during copying operation, the conversion permitting signal S1 must be outputted to control unit 2 after completion of discharging the paper P as described above.

In step #11, a check is made to see if the value of the counter SCPRG0 is "0" or not.

The counter SCPRG0 is provided in CPU 201 for controlling timing of program conversion, a value of which is normally "0".

When the counter SCPRG0 indicates a value of "0", a check is made to see if a print key as an operation key for starting copying operation has been pushed down or not (step #12).

If it is YES in step #12, in step #13, a flag FPRG indicating whether the program is being converted or not is checked.

If the flag FPRG is "0", in step #14, copying operation is started.

If flag FPRG is "1", the program is now being converted, so that malfunction might occur if copying operation is carried out. Accordingly, in this case, copying operation is not started.

In step #15, a flag FNONPRG is made "1" for showing the program conversion is impossible because it is in copying operation now.

Then, in step #16, the counter SCPRG0 is made "1".

On the other hand, if it is NO in step #11, the program proceeds to step #17 to make a check to see if the paper P has been discharged. At this time, if it is in copying operation of a multicopy mode for continuous copying on a plurality of pieces of paper P, a check is made to see if all of the set pieces of paper P have been discharged or not.

If it is YES in step #17, in step #18, a copying end process for stopping rotation of photoreceptor drum 5 and so forth are carried out.

Subsequently, the flag FNONPRG is made "0" (step #19), and a value of the counter SCPRG0 is made "0"

Figure 10:
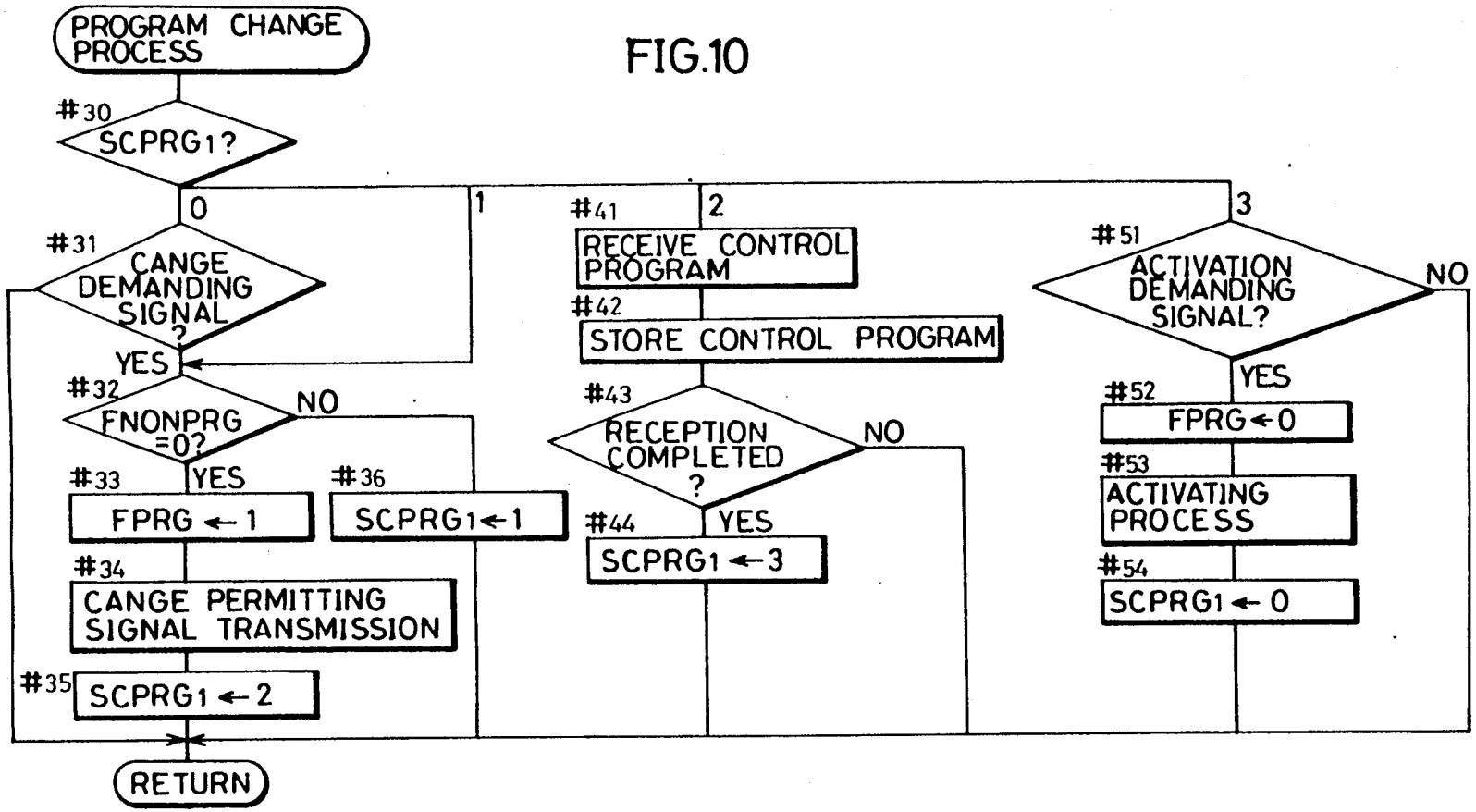
FIG. 10 is a flow chart diagram showing specific contents of a program conversion process routine of FIG. 8.

FIG. 10 is a flow chart diagram showing specific contents of a routine of program conversion process of FIG. 8.

In this routine, first, in step #30, a value of counter SCPRG1 is checked and the following processes are carried out according to the value.

If the value of the counter SCPRG1 is "0", in step #31, presence/absence of reception of a conversion demanding signal SO is checked.

If it is YES in step #31, in step #32, a check is made to see if the flag FNONPRG is "0" or not.

If it is NO in step #32, that is, if the flag FNONPRG is "1", it moves to step #36 and the value of the counter SCPRG1 is advanced to "1".

If the flag FNONPRG is "0", the program proceeds to step #33, to make the flag FPRG "1" for forbidding start of following copying operation. That is, the operation of the print key is made invalid, and output of a control signal to each portion is stopped except for a portion related to data processing for program conversion.

Then, a conversion permitting signal S1 is transmitted to control unit 2 (step #34), and the value of the counter SCPRG1 is proceeded to "2" (step #35).

In the above-described step #30, if the value of the counter SCPRG1 is "1", the program moves to step #32. That is, when the flag FNONPRG is "1", the processes of steps #32, #36 and #30 are repeated. In this way, start of program conversion is postponed until the program conversion is enabled and the flag FNONPRG attains "0".

When the value of the counter SCPRG1 is "2", in step #41, the new program PR2 from control unit 2 is received through communication interface 223, and in step #42, the received new program PR2 is sequentially stored in program memory 211.

Next, in step #43, it is confirmed whether reception of the new program PR2 is completed or not, and if the reception has been completed, in step #44, the value of the counter SCPRG1 is proceeded to "3".

When the value of the counter SCPRG1 is "3", in step #51, presence/absence of reception of an activation demanding signal S2 is checked.

If it is YES in step #51, the flag FPRG is returned to "0" (step #52).

Subsequently, in step #53, an activating process for starting control of each portion according to the new program PR2 is carried out.

Then, in step #54, the counter SCPRG1 is returned to "0" at the end.

Figure 11:
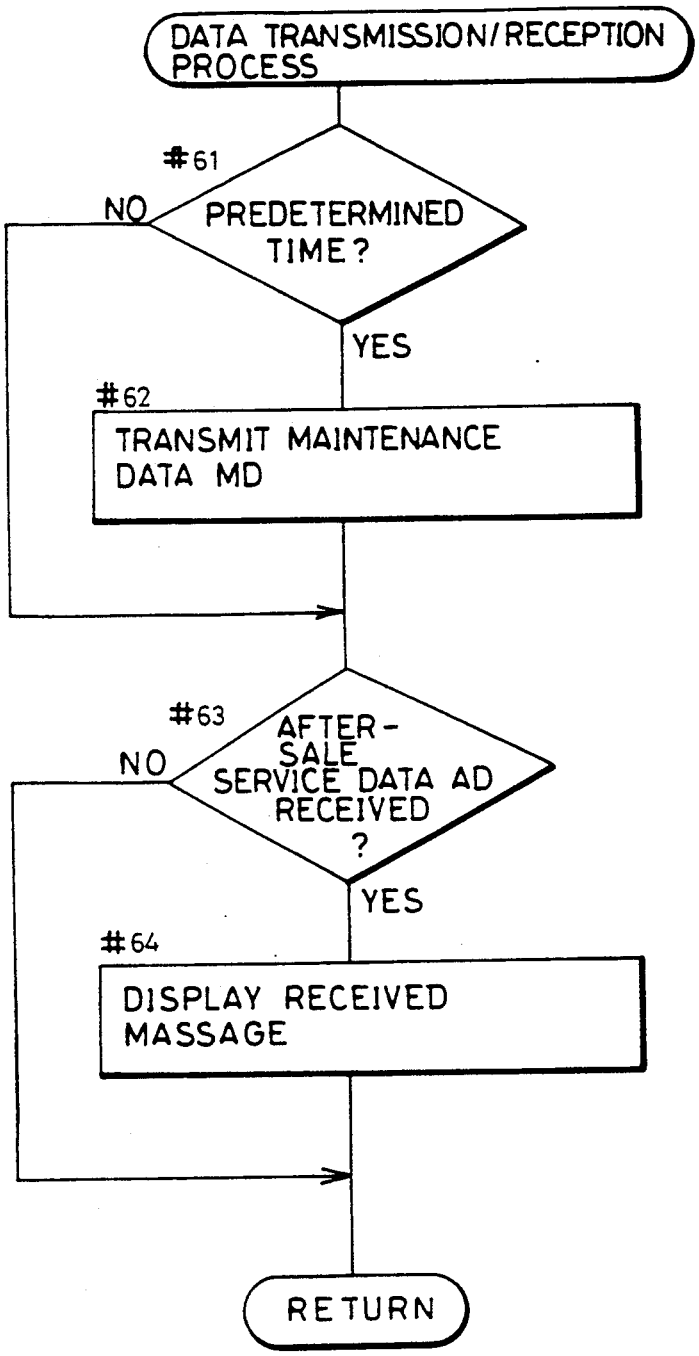
FIG. 11 is a flow chart diagram showing specific contents of the data transmission/reception process routine of FIG. 8.

FIG. 11 is a flow chart diagram showing specific contents of the data transmission/reception process routine of FIG. 8.

Figure 21:
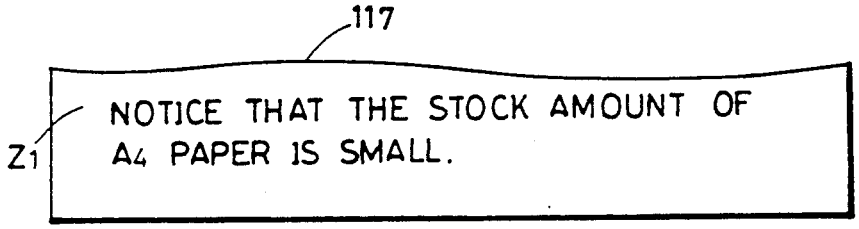
FIG. 21 is a diagram showing one example displayed in the display 117 of FIG. 4.

First, in step #61, a determination is made as to whether the time counted in the clock CK coincides with the previously set time or not. If the times coincide with each other, in step #62, the maintenance data is transmitted to the control unit. Next, in step #63, a determination is made as to whether the after service data AD is received from the control unit or not. Upon reception of the data AD, in step #64, the received contents are displayed in a display 117 of an operation panel of a copying machine as shown in FIG. 21, for example, and the program returns.

Figure 12:
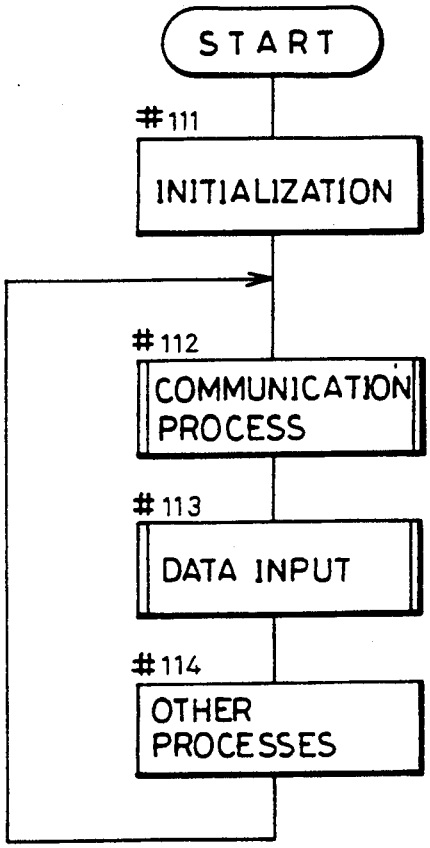
FIG. 12 is a flow chart diagram showing a main routine of a host computer of a control unit in accordance with the above embodiment of the present invention.

FIG. 12 is a control flow chart diagram showing a main routine on the side of the control unit 2.

First, in step #111, upon turning-on of a power source of the control unit, initialization such as program load are performed. Subroutines such as a communication process related to program conversion (step #112), data input (step #113) and so forth are sequentially carried out. After other processes such as totalization calculation (step #114), the program returns to step #112.

Figure 13:
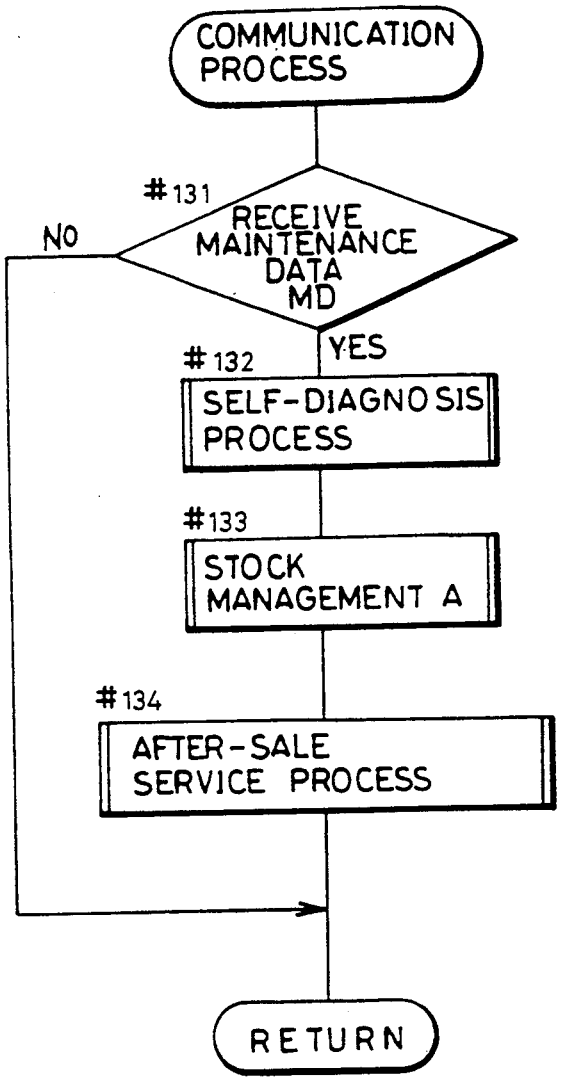
FIG. 13 is a flow chart diagram showing specific contents of the communication process routine of FIG. 12.

FIG. 13 is a flow chart diagram showing specific contents of the communication process routine of FIG. 12.

First, in step #131, a determination is made as to whether the maintenance data MD is received from the copying machine side or not. Upon reception of the data MD, a self-diagnosis process is performed in step #132. Next, a stock management process is carried out in step #133, an after-sale service process is carried out in step #134, and the program returns.

Figure 14:
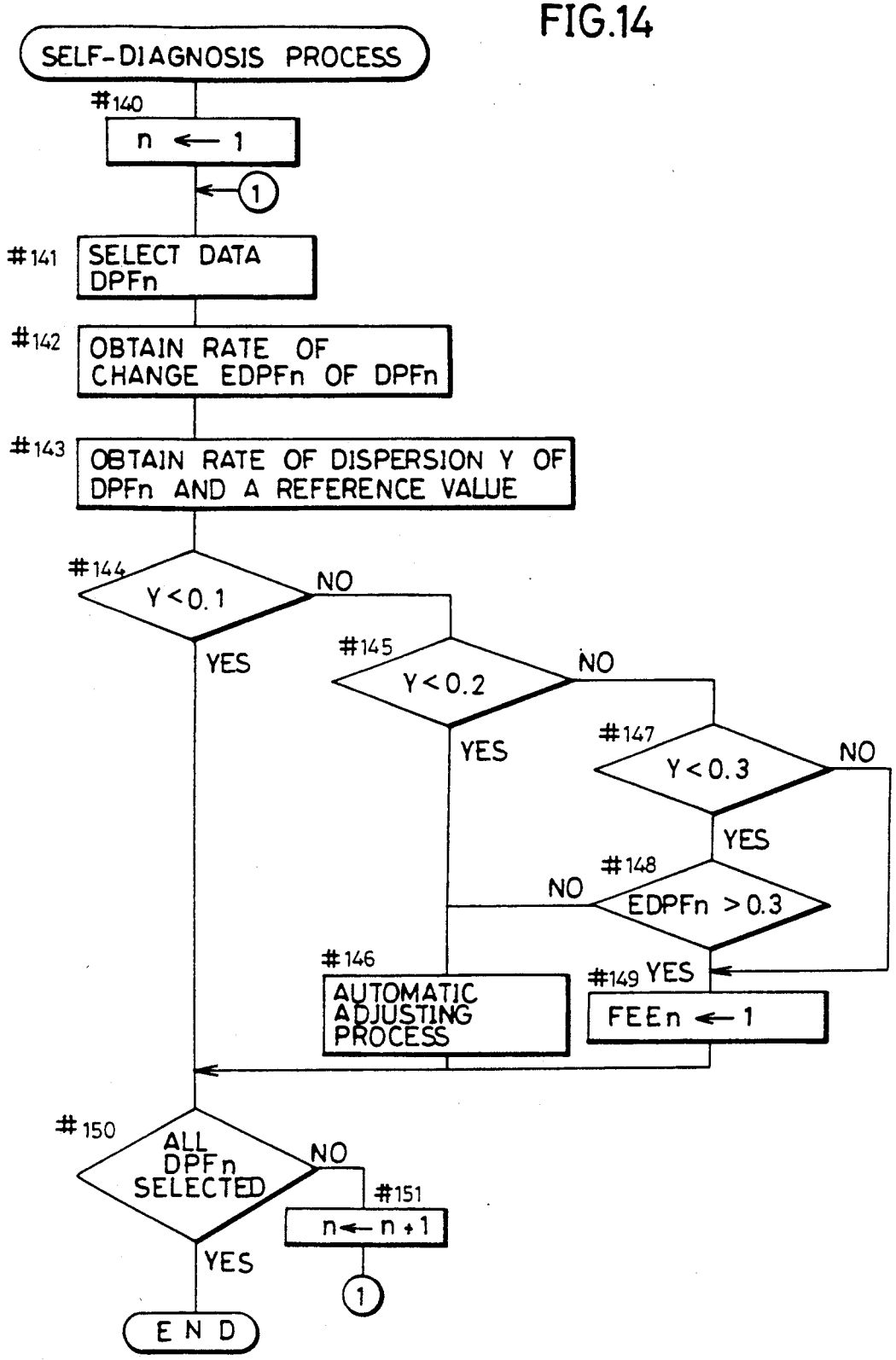
FIG. 14 is a flow chart diagram showing specific contents of the self-diagnosis process routine of FIG. 13.

FIG. 14 is a flow chart diagram showing the automatic diagnosis process of FIG. 13.

First, in step #140, with a variable n of "1", in step #141, data DPFn is selected from the condition data CD. For example, the data DPFn indicates the time T1 from start of feeding paper P by paper feed roller 31 until a head edge of the paper P reaches the transporting roller 30.

A value of the data $DPF_1$ increases as paper feed roller 31 wears to decrease a transporting speed of the paper P. The data DPFn includes a surface potential of the photoreceptor detected by VO sensor 90, image density measured by AIDC sensor 19 and so forth.

Next, in step #142, on the basis of the data DPFn received in the previous communication stored in storage device 301*a* and the data DPFn received in the present communication, the rate of change EDPFn of the data DPFn expressed as the following expression (1) is obtained.

$$EDPFn = \frac{\text{the present } DPFn - \text{the previous } DPFn}{\text{the present } DPFn} \quad (1)$$

In the following step #143, the rate of dispersion Y expressed as the following expression (2) is obtained.

$$Y = \left| \frac{DPFn - (\text{a reference value of } DPFn)}{(\text{a reference value of } DPFn)} \right| \quad (2)$$

In the expression (2), a reference value of DPFn is previously defined according to the type of the copying machine 1.

In step #144, a check is made to see if the rate of dispersion Y is less than 0.1 ($Y<0.1$) or not. If it is YES in step #144, conditions of the copying machine 1 can be regarded as appropriate, so that adjustment of paper feeding is not required.

If the rate of dispersion Y is equal to or more than 0.1, the program proceeds to step #145, and a check is made to see if the rate of dispersion Y is less than 0.2 ($Y<0.2$).

If it is YES in step #145, in step #146, an automatic adjusting process for compensating for disadvantage produced due to variation of values of DPFn is carried out.

In the automatic adjustment process, when $n=1$, for example, a remote control signal SF is transmitted to copying machine 1 for having the CPU 201 perform control of increasing a paper push-up plate at the bottom of paper feed cassette 95 to increase the contact pressure of paper feed roller 31 and the paper P, or control of setting a determination reference time of paper feeding miss according to the extension of the time T1. Also, as an automatic adjustment process, a process for reducing a count time of a paper feed interval timer defining a cycle of paper feeding can be carried out in order to prevent a decrease of the number of copies per one minute in continuous copying (multicopy).

If it is NO in step #145, the program proceeds to step #147, and a check is made to see if the rate of dispersion Y is less than 0.3 ($Y<0.3$) or not.

If it is YES in step #147, in the following step #148, a check is made to see if the rate of change EDPFn exceeds 0.3 or not. If the rate of change EDPFn exceeds 0.3, it means, for example, that the degree of wear of paper feeding roller 31 is in a permittable range at the present time, but wear of the paper feed roller 31 is rapidly proceeding, so that it must face an abnormal condition in which a trouble of paper feed (a mistake in paper feed) frequently occurs, which means parts replacement is required. Accordingly, in this case, the program proceeds to step #149 to make the flag FEEn 1.

If it is NO in step #147, that is, if the rate of dispersion Y exceeds 0.3, since copying machine 1 is already in an abnormal state, the flag FEEn is immediately made 1 ( step #149).

In this way, when the process of the selected data $DPF_1$ is completed, in step #150, a determination is made as to whether all of the data DPFn have been selected or not. When all of the data DPFn have not been selected, in step #151, after incrementing the variable n by one, the processes in the above-described steps #141-#149 are repeated for each of the data DPFn.

Figure 15:
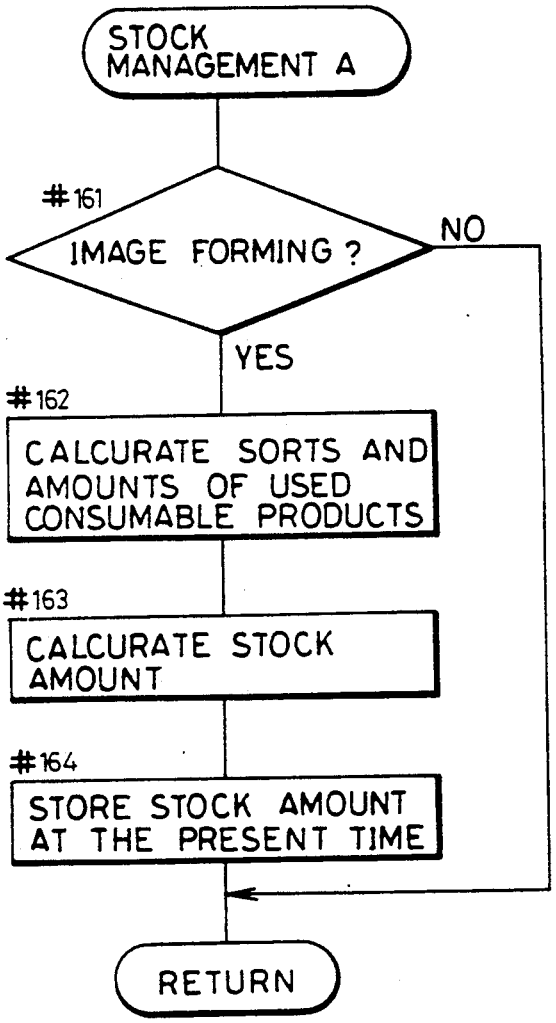
FIG. 15 is a flow chart diagram showing specific contents of the stock management A routing of FIG. 13.
Figure 20:
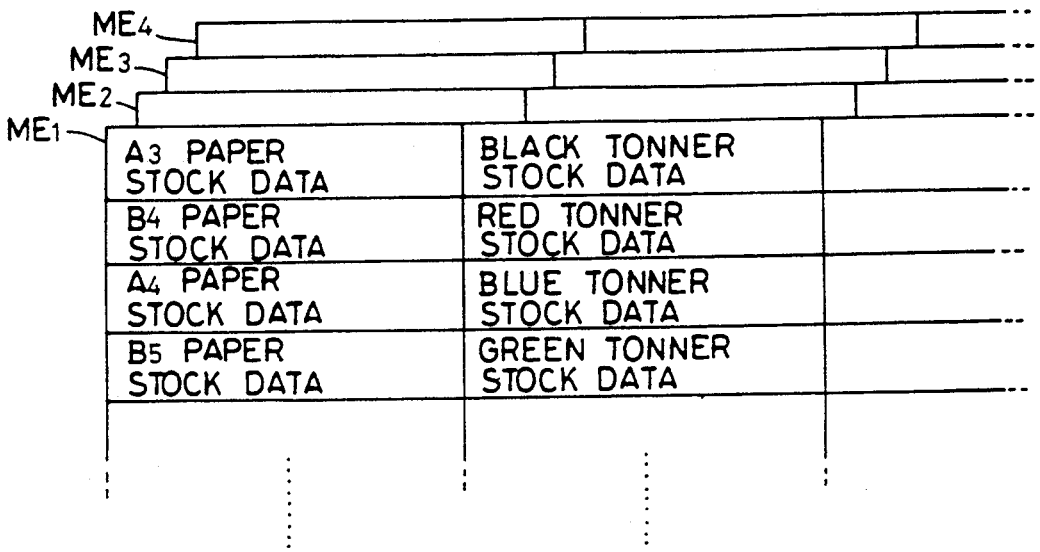
FIG. 20 is a diagram showing one example of contents of a user stock table in accordance with above embodiment of the present invention.

FIG. 15 is a flow chart diagram showing specific contents of the stock management A routine of FIG. 13, and FIG. 20 is a diagram showing contents of a user stock table UST employed for processing in FIG. 15.

As shown in FIG. 20, the user stock table UST includes storage regions ME1, ME2 ... each corresponding to each of users. Data indicating a stock amount and the smallest stock reference amount for each consumable product are stored in each storage region ME1, ME2 ....

In FIG. 15, in step #161, with the operational data OD, presence/absence of image forming after the previous data reception is checked.

In the case of image forming performed, the sorts and amounts of used consumable products are calculated (step #162), subtracting the extracted amount from a stock amount of each consumable product read out of the user stock table UST to calculate a stock amount at the present time (step #163), and the calculated present stock amount is stored in the user stock table UST as the newest stock information (step #164).

Although the host computer 301 carries out the automatic diagnosis process for detecting whether conditions of copying machine 1 require parts replacement or not on the basis of the condition data CD in the present embodiment, the CPU 201 of copying machine 1 may carry out an automatic diagnosis process and inform the host computer 301 of the processed result.

Figure 16:
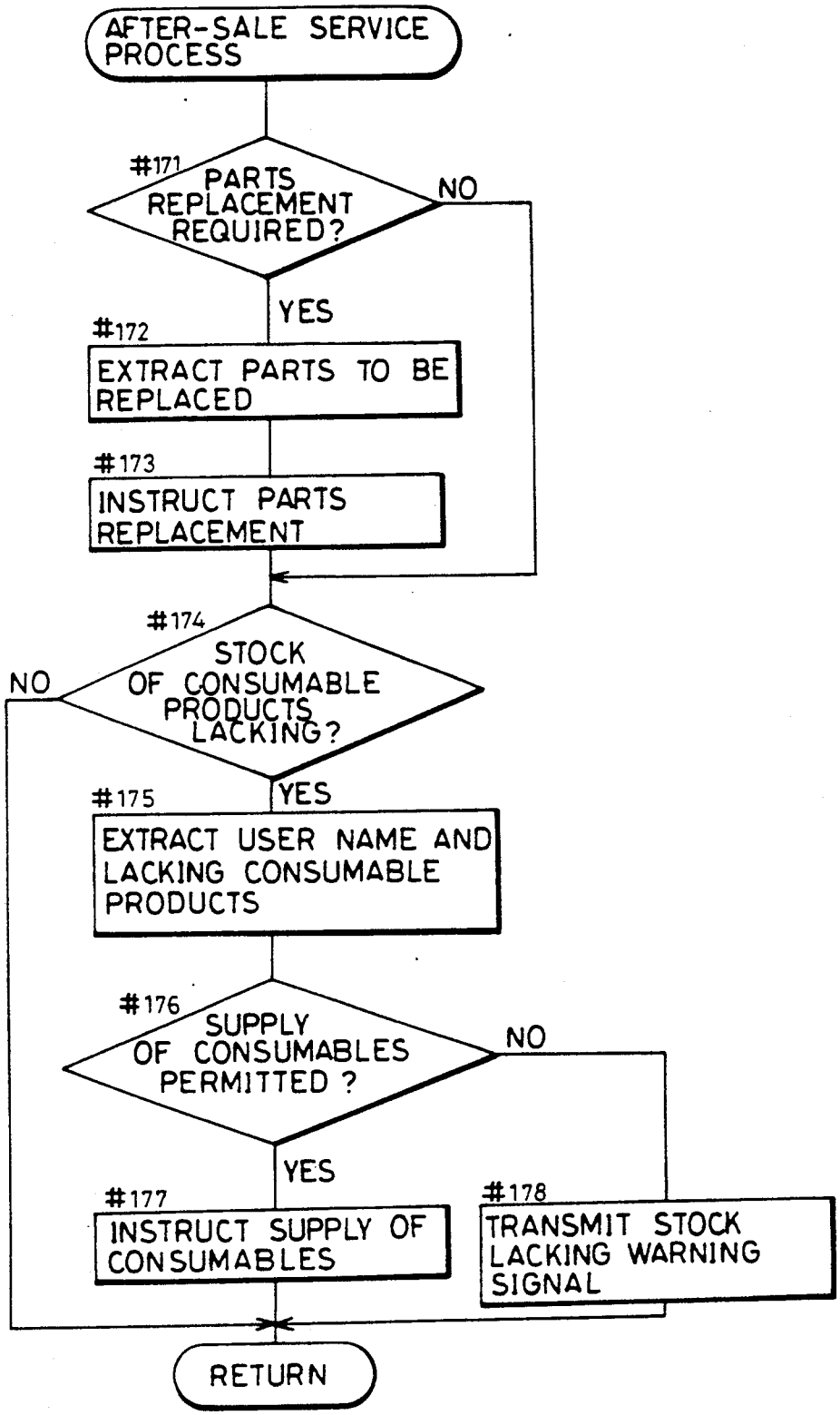
FIG. 16 is a flow chart diagram showing specific contents of the after-sale service process routine of FIG. 13.

FIG. 16 is a flow chart diagram of the after-sale service process of FIG. 13.

First, in step #171, according to conditions of each flag FEEn, a check is made to see if parts replacement is required or not.

If it is YES in step #171, a part to be replaced is extracted (step #172), and a serviceman is instructed to implement parts replacement with a maintenance work object list outputted or so by the display 302 or printer 304 (step #173).

Thus, the serviceman makes a visit to a user with prepared required repair parts for parts replacement, and prevent occurrence of abnormal conditions.

If required parts are not stocked in a service station SS, or if parts are kept at a place other than the service station SS (e.g., a manufacturing maker of the parts), in step #173, notice of delivering the parts to the service station SS (automatic parts order) is given to the manufacturing maker or so. In this case, the serviceman makes a visit to the user after arrival of the parts.

In step #174, a check is made to see if the consumable products are running out or not at each user. That is, a used amount of consumable products is estimated on the basis of the operational data OD in order to make a determination as to whether the remaining amount of the stock is less than the minimum stock reference amount. The minimum stock reference amount is predetermined for each user and for each constable product in consideration of use records of users (an average consumption amount per one day) and the number of days (time) required for supplying the consumable goods. The remaining amount of the stock also can be estimated on the basis of the use records of users and the number of days passed after the day of the last supply of the consumable products.

In step #175, a name of a user with lack of stock and the lacking consumable products are extracted.

Next, in step #176, a check is made to see if the supply of the consumable products is permitted or not. That is, a check is made to see if a so-called automatic delivery can be made or not for supplying consumable products without acknowledgement of the user for each time on the basis of a determination on the service station SS side. As to the automatic delivery, an agreement is made in advance in the maintenance contract with each user, and the data indicating contents of the agreement are stored in the user stock table UST.

If it is YES in step #176, in step #177, printer 304 and display 302 are operated in order to instruct the serviceman to supply consumable products. When a supply base of consumable products exist separately from the service station SS, a notice is given to the supply base for demanding supply of consumable goods of predetermined amounts (an automatic consumable products order).

If it is NO in step #176, it proceeds to step #178, and a stock lack warning signal SA is transmitted to copying machine 1. In this case, in display 117 of copying machine 1, as shown in FIG. 21, for example, a message Z1 is displayed for notifying a user that the stock of paper P of A4 size is running out.

Figure 17:
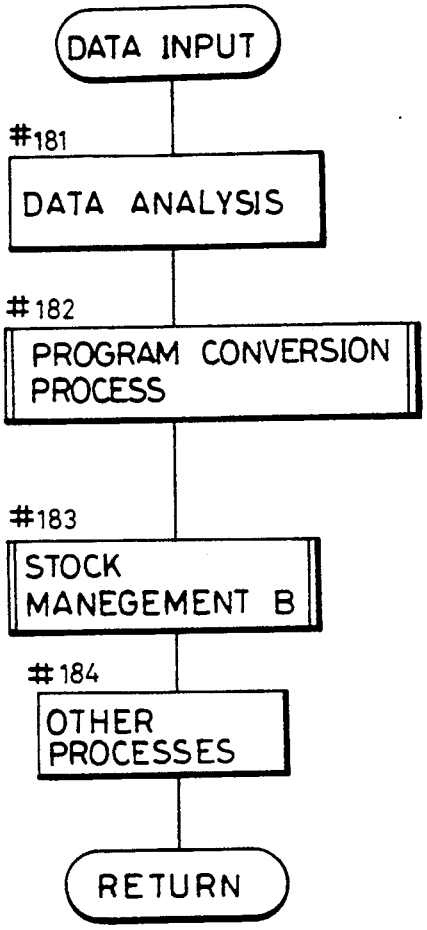
FIG. 17 is a flow chart diagram showing specific contents of the input process routine of FIG. 12.

FIG. 17 is a flow chart diagram showing specific contents of the data input routine of FIG. 12.

In step #181, the data inputted from keyboard 303 are analyzed. Next, in step #182, a program conversion process is carried out. Subsequently, in step #183, a stock management process is carried out and then other processes are carried out in step #184, and the program returns.

Figure 18:
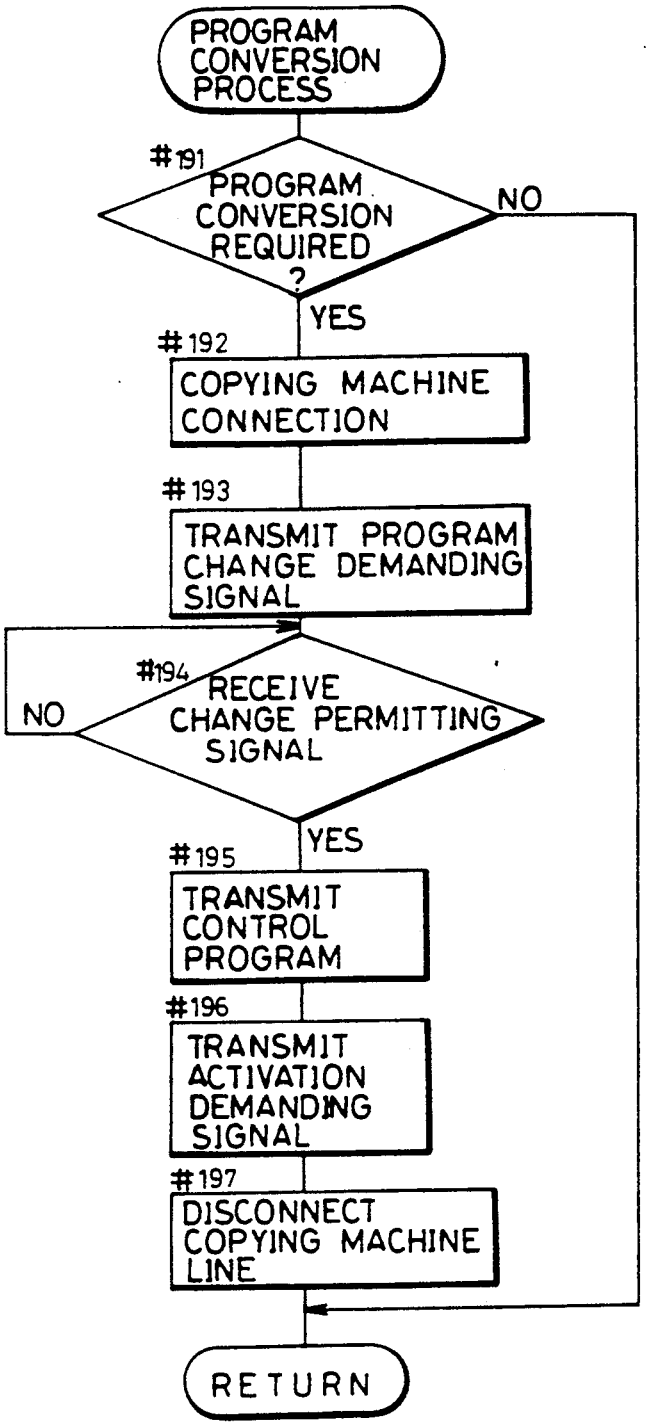
FIG. 18 is a flow chart diagram showing specific contents of the program conversion process routine of FIG. 17.

In the program conversion process routine shown in FIG. 18, when a con, hand for changing a program of the copying machine is inputted from keyboard 303 in order to add a new function, for example (YES in step #191), a line is connected to the copying machine in which a program is changed (step #192), and a conversion demanding signal is transmitted to the machine (step #193). Then, upon reception of a conversion permitting signal from the copying machine (step #194), a control program is transmitted (step #195). Upon completion of transmitting the program, an activation demand signal is transmitted to the machine (step #196), the line connected with the copying machine is disconnected (step #197), and program returns to the main routine.

Figure 19:
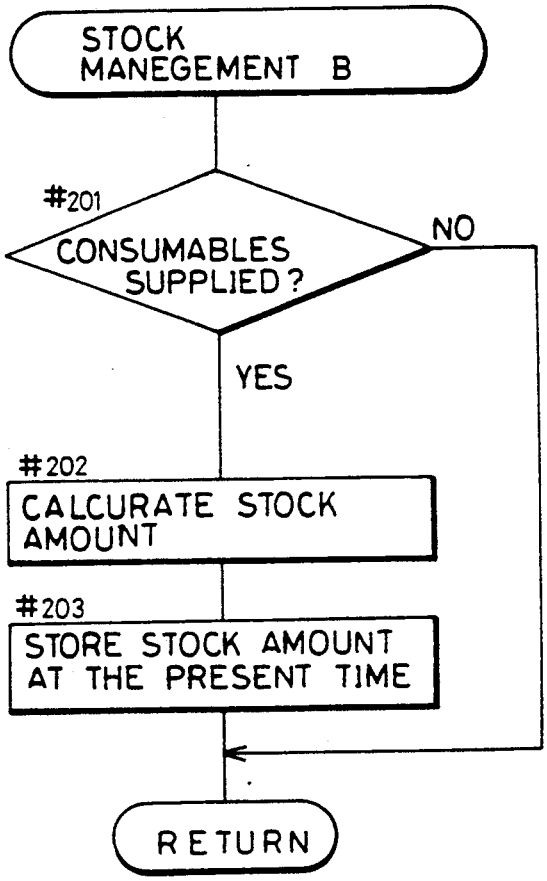
FIG. 19 is a flow chart diagram showing specific contents of the stock management B routine of FIG. 17.

FIG. 19 is a flow chart indicating specific contents of the stock management B routine of FIG. 17.

In step #201, a determination is made as to whether consumable products have been supplied or not. If the consumable products have been supplied, in step #202, the inputted amounts of the consumable products are added to the stock amounts before input to calculate the stock amounts at the present time. For example, when 20000 sheets of paper P of A4 size are delivered, with 512 sheets of stock amount of A4 paper stock data, the stock amount after addition becomes 20512.

Then, in step #203, the stock amount obtained in step #202 (e.g. 20512) is stored as the newest stock amount.

Figure 22:
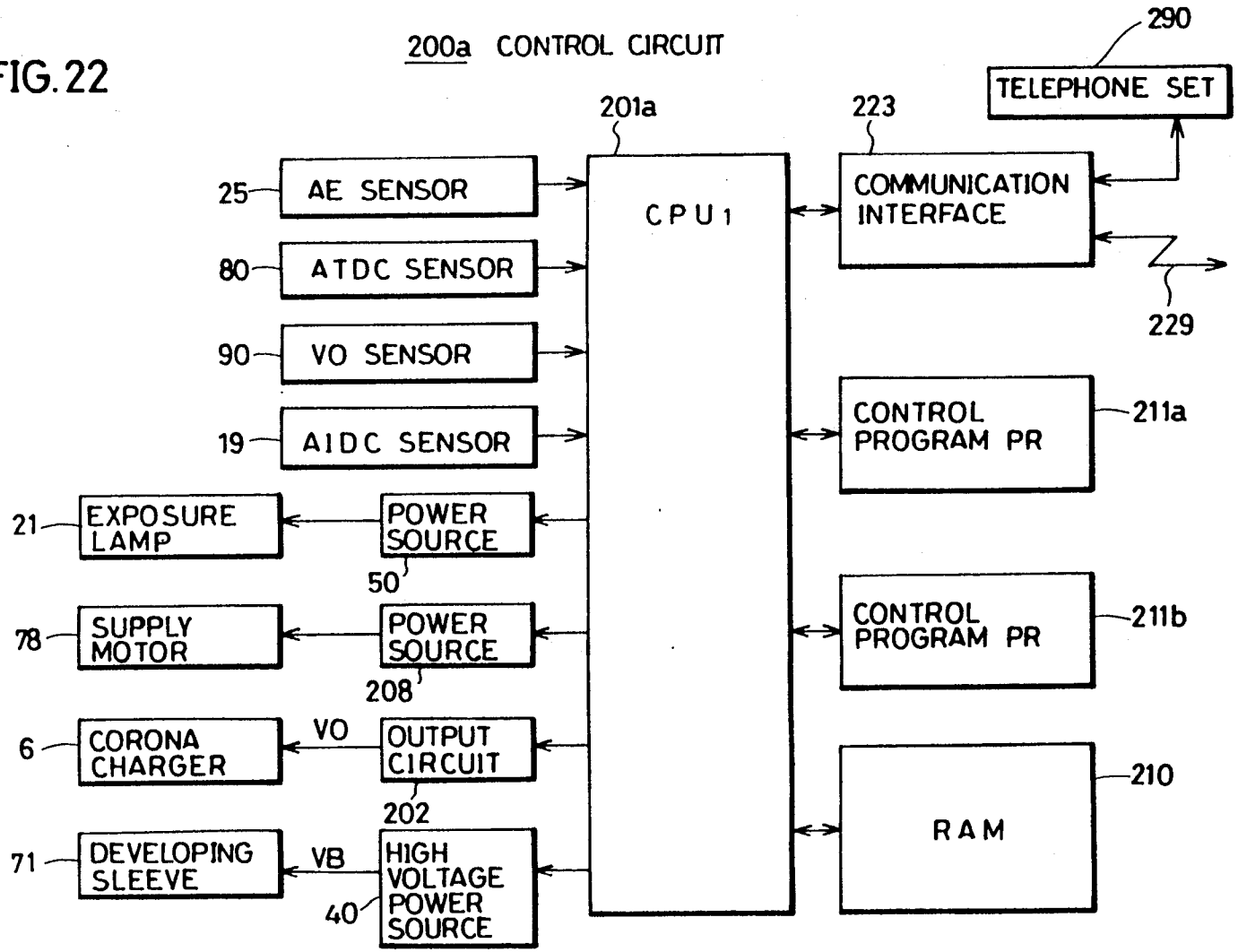
FIG. 22 is a block diagram showing a configuration of a copying machine in accordance with another embodiment of the present invention.

FIG. 22 is a block diagram of a control circuit 200*a* in accordance with another embodiment of the present invention. In the figure, the same characters are assigned to the components with the same functions as those in FIG. 3, and description thereof is not repeated.

The control circuit 200*a* includes two program memories 211*a* and 211*b* in which the control program PR can be written. These program memories 211*a* and 211*b* include nonvolatile storage devices as well as the above-described program memory 211.

CPU 201*a* controls operation of copying machine 1 according to the old program PR1 stored in one of program memories 211*a* and 211*b*. The CPU 201*a*, if a conversion demanding signal SO is applied from the control unit 2, receives the new program PR2 in parallel with the present control, and stores the same into the other program memory 211*b* or 211*a*.

Subsequently, CPU 201*a* switches the carried out control program PR from the old program PR1 to the new program PR2 at an appropriate time for control in each portion. That is, in control circuit 200*a*, the two program memories 211*a* and 211*b* are alternately used as storage means for the old program PR1 or the new program PR2 for each program conversion. In this way, regardless of presence/absence of copying operation, the program conversion can be implemented any time.

In the above-described embodiment, as to the control circuits 200, 200*a*, the copying machine 1 can be configured so that the power is always supplied thereto regardless of ON/OFF of a power source for other component portions (main power source) to implement program conversion in a time period except for a work time of a user, e.g., late at night.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control system including a plurality of image forming apparatuses and a control unit connected to each of said image forming apparatuses through a communication line, wherein each of said image forming apparatuses comprises operational data transmitting means for transmitting operational data including information related to a consumption amount of consumables to said control unit through said communication line, and said control unit comprises;

operational data receiving means for receiving the operational data transmitted from said image forming apparatus through said communication line, input means for inputting consumables supply data corresponding to an amount of consumables supplied to a user of each of said image forming apparatuses, memory means for storing the consumables supply data input from said input means, and calculating means for calculating a present stock amount of consumables, including consumables that are not loaded in said image forming apparatus, on the basis of the operational data received by said operational data receiving means and the consumables supply data stored in said memory means.

2. The control system according to claim 1, wherein;

said control unit further comprises warning means for giving a predetermined warning on the basis of the present stock amount calculated by said calculating means.

3. The control system according to claim 2, wherein said warning means comprises a display device.

4. The control system according to claim 1, wherein said control unit further comprises warning signal transmitting means for generating and transmitting a warning signal to said image forming apparatus through said communication line on the basis of the present stock amount calculated by said calculating means, and said image forming apparatus comprises warning means for generating a warning in response to the warning signal transmitted from said warning signal transmitting means.

5. The control system according to claim 4, wherein said warning means comprises display means for displaying a predetermined message.

6. A control system of an image forming apparatus, comprising:

image forming means for forming an image on paper;

detecting means for detecting a consumption amount of consumables used in an image forming operation by said image forming means;

input means for inputting consumables supply data corresponding to an amount of consumables supplied to a user of said image forming apparatus;

memory means for storing the consumables supply data input from said input means; and calculating means for calculating a present stock amount of the consumables including consumables that are not loaded in said image forming apparatus on the basis, of a result detected by said detecting means and the consumables supply data stored in said memory means.

7. The control system according to claim 6, further comprising warning means responsive to said calculating means for giving a warning indicating that said present stock amount is lacking.

8. An image forming apparatus connectable to an external device through a communication line, comprising:

image forming means for forming an image on paper;

storing means for storing a control program;

control means for controlling said image forming means by running the control program stored in said storing means;

receiving means for receiving information transmitted from said external device through said communication line; and changing means for changing the control program stored in said storing means to a new control program on the basis of the information received by said receiving means, wherein said storing means simultaneously stores the control program and the new control program wherein said control means is operable to run the control program while said changing means is changing the control program to the new program.

9. An image forming apparatus, comprising:

image forming means for forming an image on paper;

nonvolatile storing means for storing a control program;

control means for controlling said image forming means on the basis of the control program stored in said storing means; and means for replacing the control program stored in said storing means with an updated program and storing the updated program in said storing means while holding the original control program in the storing means so that said control means is operable to control said image forming means on the basis of the original control program during a replacing operation.

10. The image forming apparatus of claim 9, wherein said storing means further comprises at least two memory means for holding control programs, wherein one of said memory means holds the original control program and another of said memory means holds the updated control program.

11. An image forming apparatus, comprising:

image forming means for forming an image on paper;

storing means for storing a control program;

control means for controlling said image forming means by running the control program stored in said storing means;

information receiving means for receiving information related to said control program; and changing means for changing the control program stored in said storing means to a new control program on the basis of the information received by said information receiving means, wherein said storing means simultaneously stores the control program and the new control program wherein said control means is operable to run the control program while said changing means is changing the control program to the new control program.

12. An image forming apparatus, comprising:

image forming means for forming an image on paper;

storing means for storing a control program;

control means for controlling said image forming means by running the control program stored in said storing means;

information receiving means for receiving information related to said control program;

means for changing the control program stored in said storing means on the basis of the information received by said information receiving means; and means for forbidding image forming operation by said image forming means during changing the control program.

13. A control system of image forming apparatus including a plurality of image forming apparatus and a control unit connected to each of said image forming apparatus through a communication line, wherein each of said image forming apparatus comprises;

image forming means for forming an image on paper, storing means for storing a control program for controlling said image forming means, control means for controlling said image forming means in accordance with the control program stored in said storing means, receiving means for receiving a signal transmitted from said control unit through said communication line, and program changing means for changing contents of the control program stored in said storing means, said control unit comprises transmitting means for transmitting a program change signal instructing change of the control program to said image forming apparatus through said communication line, and said program change means performs change operation of the control program in response to reception of said program change signal from said control unit by said receiving means.

14. The control system according to claim 13, wherein said control unit transmits a control program to be stored in said storing means to said image forming apparatus through said communication line.

15. The control system according to claim 13, wherein each of said image forming apparatus further comprises forbidding means for forbidding image forming operation by said image forming means during change of the control program by said program change means.

16. The control system according to claim 15, wherein each of said image forming apparatus further comprises determination means for determining completion of change operation of the control program by said program change means, and said control means, responsive to determination output of completion of change operation of the control program by said determination means, starts controlling said image forming means in accordance with control program after change, and also controls said forbidding means so that prohibition of said image forming operation by said forbidding means is released.

17. The control system according to claim 13, wherein each of said image forming apparatus further comprises means for forbidding operation of said program change means during image forming operation by said image forming means.

18. The control system according to claim 13 wherein said program change means changes the control program after completion of the image forming operation when said program change signal is received by said receiving means during image forming operation by said image forming means.

19. The control system according to claim 13, wherein each of said image forming apparatus further comprises demanding means for transmitting a program transmission demanding signal to said control unit through said communication line when said program change signal is received and said image forming means is not operating, and said control unit comprises program transmitting means for transmitting a control program to be stored in said storing means to said image forming apparatus through said communication line in response to the program transmission demanding signal from each of said image forming apparatus.

20. An image forming apparatus connectable to an external device through a communication line, comprising:

image forming means for forming an image on paper;

a memory for storing a control program;

a processor for controlling said image forming means by performing the control program stored in said memory;

first receiving means for receiving a demand signal transmitted from said external device through the communication line;

responding means for transmitting a permitting signal to said external device through the communication line and forbidding an operation of said image forming means in response to the demand signal received by said first receiving means;

second receiving means for receiving a new control program transmitted from said external device after the permitting signal is transmitted by said responding means; and changing means for changing the control program stored in said memory to the new control program received by said second receiving means.

21. An image forming apparatus connectable to an external device through a communication line, comprising:

image forming means for forming an image on paper;

first and second memory means for storing control programs;

a processor for controlling said image forming means by performing the control program stored in one of said first and second memory means;

receiving means for receiving a new control program transmitted from said external device;

means for storing the new control program received by said receiving means into one of said first and second memory means in which the control program presently performed by said processor is not stored; and switching means for switching a control program to be performed by said processor to the new control program stored in one of said first and second memory means.

* * * * *

UNITED STATES PATENT AND TRADEMARK OFFICE

CERTIFICATE OF CORRECTION

PATENT NO. : 5,335,048

DATED : August 2, 1994

INVENTOR(S) : Yoshiaki TAKANO et al

It is certified that error appears in the above-indentified patent and that said Letters Patent is hereby corrected as shown below:

Title page, under Foreign Application Priority Data item [30], kindly delete "Jan. 30, 1990" and insert -- Jan. 31, 1990 --.

item [30], kindly delete "Jan. 30, 1990" (second occurrence) and insert -- Jan. 31, 1990 --.

Signed and Sealed this

Twentieth Day of September, 1994

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,335,048

DATED : August 2, 1994

INVENTOR(S) : Takano et al.

It is certified that error appears in the above-indentified patent and that said Letters Patent is hereby corrected as shown below:

ON THE TITLE PAGE:

In Section [75], delete "Kadotari Nishimori" and insert

--Kadotaro Nishimori--

Signed and Sealed this

Twentieth Day of June, 1995

*Attest:*

Bruce Lehman

BRUCE LEHMAN

*Attesting Officer*

*Commissioner of Patents and Trademarks*